US011413737B2

(12) United States Patent
Duerr et al.

(10) Patent No.: US 11,413,737 B2
(45) Date of Patent: Aug. 16, 2022

(54) HAND-HELD POWER TOOL WITH A MODE-SETTING DEVICE

(71) Applicant: Robert Bosch GmbH, Stuttgart (DE)

(72) Inventors: Thomas Duerr, Asperg (DE); Istvan Munkacsi, Tiszavasvari (HU); Tibor Bohos, Tiszavasvari (HU)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/768,687

(22) PCT Filed: Nov. 26, 2018

(86) PCT No.: PCT/EP2018/082473
§ 371 (c)(1),
(2) Date: May 31, 2020

(87) PCT Pub. No.: WO2019/110339
PCT Pub. Date: Jun. 13, 2019

(65) Prior Publication Data

US 2021/0187719 A1 Jun. 24, 2021

(30) Foreign Application Priority Data

Dec. 6, 2017 (DE) ..... 10 2017 222 006.6

(51) Int. Cl.
*B25F 5/00* (2006.01)
*B25B 21/00* (2006.01)
*B25D 16/00* (2006.01)

(52) U.S. Cl.
CPC ..... *B25F 5/001* (2013.01); *B25B 21/00* (2013.01); *B25D 16/006* (2013.01);
(Continued)

(58) Field of Classification Search
CPC ..... B25F 5/001; B25B 21/00; B25D 16/006; B25D 2216/0023; B25D 2216/0038; B25D 2250/165
See application file for complete search history.

(56) References Cited

U.S. PATENT DOCUMENTS 5,025,903 A * 6/1991 Elligson ..... B25B 21/00 173/13
5,573,074 A * 11/1996 Thames ..... B25B 21/008 173/178

(Continued)

FOREIGN PATENT DOCUMENTS

CH 696 902 A5 1/2008
DE 696 21 002 T2 11/2002

(Continued)

OTHER PUBLICATIONS

International Search Report corresponding to PCT Application No. PCT/EP2018/082473, dated Mar. 29, 2019 (German and English language document) (7 pages).

*Primary Examiner* — Robert F Long
*Assistant Examiner* — Eduardo R Ferrero
(74) *Attorney, Agent, or Firm* — Maginot, Moore & Beck LLP

(57) ABSTRACT

A hand-held power tool includes a housing in which a drive motor and a transmission that is configured to be driven by the drive motor so as to drive an output shaft are arranged. The hand-held power tool also includes a mode-setting device that has at least one rotatable actuation element configured to set an operating mode, a torque-adjusting element configured to adjust a torque, and a gear changing element configured to change gears of the transmission. The torque adjusting element and the gear changing element are releasably coupled together during a gear changing process.

18 Claims, 26 Drawing Sheets

(52) U.S. Cl.
CPC ..... *B25D 2216/0023* (2013.01); *B25D 2216/0038* (2013.01); *B25D 2250/165* (2013.01)

(56) References Cited

U.S. PATENT DOCUMENTS

| | | | | |
|---|---|---|---|---|
| 5,704,433 | A * | 1/1998 | Bourner | B25B 23/14 173/178 |
| RE37,905 | E * | 11/2002 | Bourner | B25B 23/14 173/178 |
| 7,121,359 | B2 * | 10/2006 | Frauhammer | B25D 16/006 173/48 |
| 7,410,007 | B2 * | 8/2008 | Chung | B25B 21/02 173/176 |
| 2002/0096343 | A1 * | 7/2002 | Potter | B25B 21/00 173/216 |
| 2006/0086514 | A1 * | 4/2006 | Aeberhard | B25B 21/00 173/48 |
| 2006/0201688 | A1 * | 9/2006 | Jenner | B25D 16/006 173/48 |
| 2006/0237205 | A1 * | 10/2006 | Sia | B25B 23/1405 173/48 |
| 2008/0308286 | A1 * | 12/2008 | Puzio | B25B 21/026 173/210 |
| 2009/0101376 | A1 * | 4/2009 | Walker | B25B 21/00 173/47 |
| 2009/0126956 | A1 * | 5/2009 | Trautner | B25D 11/106 173/48 |
| 2009/0126957 | A1 * | 5/2009 | Schroeder | B25D 16/006 173/48 |
| 2009/0194305 | A1 * | 8/2009 | Xu | B25B 21/02 173/48 |
| 2010/0163261 | A1 * | 7/2010 | Tomayko | B25F 5/001 173/47 |
| 2010/0206591 | A1 * | 8/2010 | Schroeder | B25D 16/006 173/48 |
| 2011/0127059 | A1 * | 6/2011 | Limberg | F16D 7/044 173/216 |
| 2013/0206435 | A1 * | 8/2013 | Papp | B25F 5/001 173/20 |
| 2013/0269461 | A1 * | 10/2013 | Hecht | B25D 16/003 74/335 |
| 2013/0333907 | A1 * | 12/2013 | Hecht | B25D 16/006 173/48 |
| 2015/0273678 | A1 * | 10/2015 | Schenk | B25F 5/001 173/214 |
| 2018/0133879 | A1 * | 5/2018 | Hecht | B25D 11/102 |
| 2018/0361558 | A1 * | 12/2018 | Fuchs | B25F 5/00 |
| 2018/0361559 | A1 * | 12/2018 | Bantle | B25D 11/06 |
| 2018/0370011 | A1 * | 12/2018 | Bantle | B25F 5/001 |

FOREIGN PATENT DOCUMENTS

| | | | |
|---|---|---|---|
| DE | 10 2010 029 267 | A1 | 12/2011 |
| DE | 10 2010 042 682 | A1 | 4/2012 |
| DE | 10 2015 211 700 | A1 | 12/2016 |
| DE | 10 2015 226 087 | A1 | 6/2017 |
| DE | 10 2015 226 089 | A1 | 6/2017 |
| EP | 2 062 697 | A1 | 5/2009 |

* cited by examiner

HAND-HELD POWER TOOL WITH A MODE-SETTING DEVICE

This application is a 35 U.S.C. § 371 National Stage Application of PCT/EP2018/082473, filed on Nov. 26, 2018, which claims the benefit of priority to Ser. No. DE 10 2017 222 006.6, filed on Dec. 6, 2017 in Germany, the disclosures of which are incorporated herein by reference in their entirety.

BACKGROUND

The present disclosure relates to a hand-held power tool comprising a housing, in which there are arranged a drive motor and a transmission that can be driven by the drive motor for the purpose of driving an output shaft, wherein a mode-setting means is provided, which has at least one rotatable actuating element for setting an operating mode, one torque-setting element for setting a torque, and one gear-changing element for changing gears of the transmission.

Such a hand-held power tool, realized as a drill/driver and percussion-drill/driver, is known from the prior art. The hand-held power tool has a drive motor, arranged in a housing, and a transmission. The drive motor in this case drives the transmission for the purpose of driving an output shaft. The hand-held power tool in this case can be set to differing operating modes, e.g. a screwdriving mode, a drilling mode and a percussive drilling mode. For the purpose of setting the operating mode, the hand-held power tool has a mode-setting means provided with a rotatable actuating element. In this case, rotation of the actuating element results in a setting of an actuating mode, in which a torque setting, assigned to the respective operating mode, a gear setting of the transmission and, optionally, an activation/deactivation of a percussion mechanism are effected. In this case, a torque setting and a gear change are effected via an inner contour assigned to the actuating element.

SUMMARY

The present disclosure provides a hand-held power tool comprising a housing, in which there are arranged a drive motor and a transmission that can be driven by the drive motor for the purpose of driving an output shaft, wherein a mode-setting means is provided, which has at least one rotatable actuating element for setting an operating mode, one torque-setting element for setting a torque, and one gear-changing element for changing gears of the transmission. The torque-setting element and the gear-changing element are separably coupled to each other during a gear change.

The disclosure thus makes it possible to provide a hand-held power tool in which the detachable coupling of the torque-setting element with the gear-changing element enables the mode-setting means to be operated easily and safely. A single actuating element, by which an automatic gear change can be achieved, can thus be provided in a simple manner.

Preferably, during setting of a torque, the torque-setting element and the gear-changing element are decoupled from each other. The transmission ratio can thus be arranged unchanged in the first gear, over an entire settable torque setting range, including a maximum torque position of the torque-setting element, in a simple and uncomplicated manner.

The mode-setting means preferably has a coupling element that is movably arranged on the torque-setting element. A compact and robust coupling can thus be achieved.

According to one embodiment, the coupling element is arranged in a pivotable manner on the torque-setting element. A suitable arrangement of the coupling element can thus be achieved in a simple and uncomplicated manner.

Preferably, the coupling element is arranged in an axially movable manner on the torque-setting element. An alternative arrangement of the coupling element can thus be achieved in a simple manner.

The coupling element preferably has a guide element that, upon a rotation of the actuating element, acts in combination with a guideway that is solid with the housing. Safe and uncomplicated coupling and/or decoupling can thus be achieved.

The guide element is preferably realized in the radial direction of the mode-setting means. Robust and reliable guiding of the guide element in the guideway can thus be achieved.

According to one embodiment, the guideway is realized, in the circumferential direction, on an inner face of the housing. A compact and uncomplicated arrangement of the guideway can thus be achieved.

Preferably, the gear-changing element is rotatably mounted. Thus, when a coupling is effected, a rotational movement of the actuating element can be transmitted to the gear-changing element for the purpose of gear changing.

Preferably, a torque-limiting means is provided, wherein the torque-setting element acts in combination with the torque-limiting means. Activation and/or deactivation of the torque-limiting means can thus be achieved in a simple manner via the mode-setting means.

According to one embodiment, a percussion mechanism is provided, wherein the mode-setting means is designed to activate and/or deactivate the percussion mechanism. Safe and uncomplicated activation and/or deactivation of the percussion mechanism can thus be achieved.

The transmission is preferably realized in the manner of a planetary transmission, having a selector ring gear that can be shifted by means of a selector bail, wherein the gear-changing element has a loading element for applying load to selector bail, at least during a gear change. It is thereby made possible to achieve a gear change in a simple and reliable manner.

Preferably assigned to the gear-changing element is an operating-mode indicator element, which is moved in the longitudinal direction of the housing during setting of an operating mode, and which visualizes a respectively assigned operating mode. A currently set operating mode can thus be indicated to a user in a simple and uncomplicated manner.

The mode indicator element is preferably realized as a loading element for applying load to the selector bail and/or for mode display. A suitable mode indicator element can thus be provided in a simple manner.

Preferably, the gear-changing element has a guide pin, and the mode indicator element has a guide groove, wherein the guide pin moves the mode indicator element along the guide groove during setting of an operating mode. Indication of an operating mode can thus be provided in a simple and space-saving manner.

BRIEF DESCRIPTION OF THE DRAWINGS

The disclosure is explained in greater detail in the description that follows, on the basis of exemplary embodiments represented in the drawings. There are shown.

DETAILED DESCRIPTION

Figure 1:
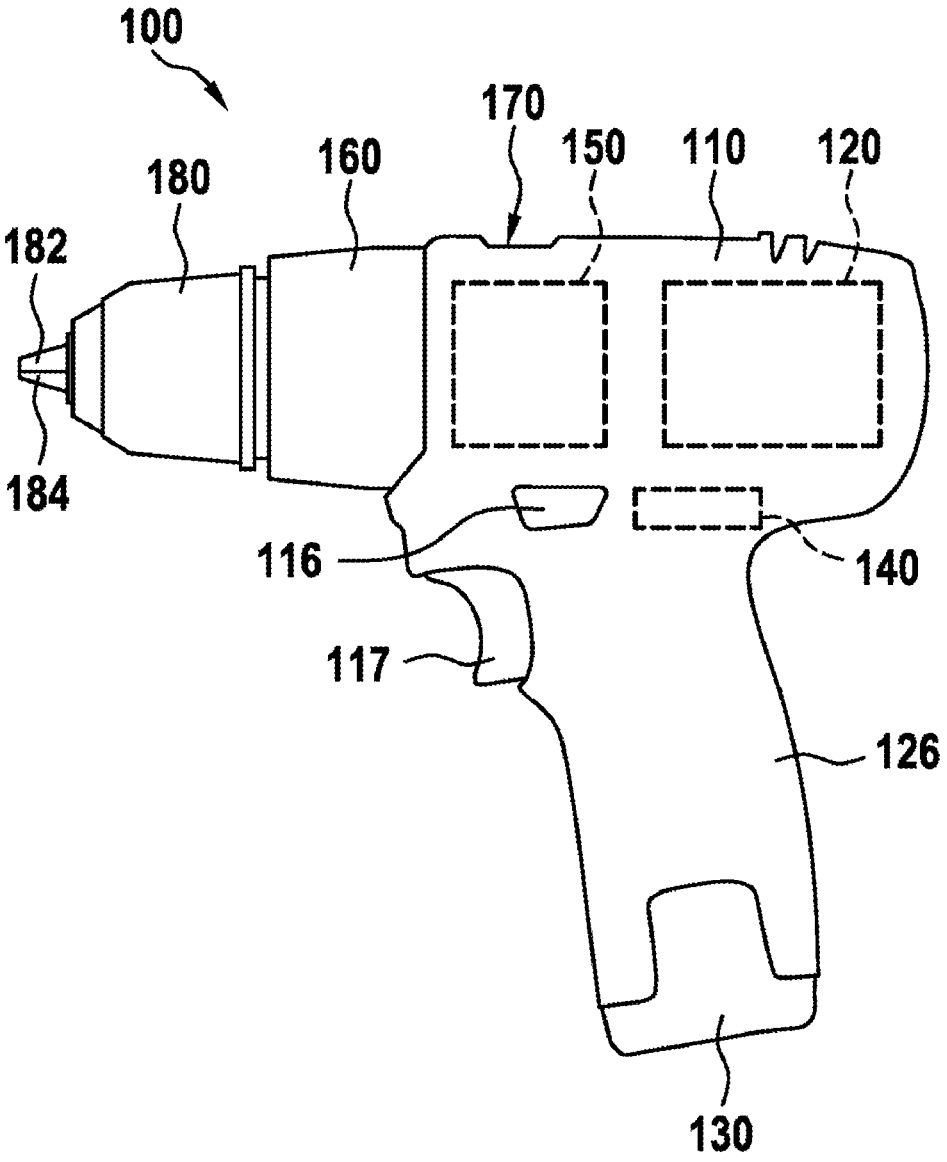
FIG. 1 a side view of a hand-held power tool having a mode-setting means according to the disclosure, FIG. 2 a perspective top view of the mode-setting means of FIG. 1, assigned to which is a torque-setting element and a gear-changing element, with an opened housing of the hand-held power tool of FIG. 1, FIG. 3 a perspective view of the mode-setting means of FIG. 2, with the torque-setting element and the gear-changing element, and with a transmission assigned to the hand-held power tool of FIG. 1, FIG. 4 a side view of a housing shell assigned to the hand-held power tool of FIG. 1 to FIG. 3, FIG. 5 a longitudinal section through the mode-setting means of FIG. 3, FIG. 6 a perspective exploded view of the mode-setting means of FIGS. 2 and 3, of the transmission of FIG. 3, of a torque-limiting unit assigned to the hand-held power tool, and of a percussion mechanism, FIG. 7 a perspective detail view of the hand-held power tool of FIG. 1 with an opened housing, to illustrate the mode-setting means of FIGS. 2 and 3 in a first operating mode, FIG. 8 a perspective detail view of the hand-held power tool of FIG. 1 with an opened housing, to illustrate the mode-setting means of FIGS. 2 and 3 in a second operating mode, FIG. 9 a top vies of the hand-held power tool of FIG. 1, having a mode indicator element assigned to the mode-setting means of FIG. 2 and FIG. 3, FIG. 10 a top view of the hand-held power tool of FIG. 1, having a mode indicator element assigned to the mode-setting means of FIG. 2 and FIG. 3, in the first operating mode, FIG. 11 a top view of the hand-held power tool of FIG. 1, having a mode indicator element assigned to the mode-setting means of FIG. 2 and FIG. 3, in the second operating mode, FIG. 12 a perspective exploded view of a mode-setting means according to a further embodiment, FIG. 13 a side view of the mode-setting means of FIG. 12, in the first operating mode, FIG. 14 a top view of the mode-setting means of FIG. 13, have a mode indicator element, FIG. 15 a top view of a coupling element, assigned to the mode-setting means of FIG. 12 to FIG. 14, that is arranged in an actuating element of the mode-setting means, FIG. 16 a perspective and partially sectional view of the actuating element with the coupling element of FIG. 15, FIG. 17 a perspective and partially sectional view of the mode-setting means of FIG. 12 to FIG. 14, in the first operating mode, FIG. 18 a longitudinal view through the hand-held power tool of FIG. 1, with the mode-setting means of FIG. 17, in the first operating mode, FIG. 19 a perspective longitudinal section through the mode-setting means of FIG. 18, FIG. 20 a partial sectional and partially perspective view of the mode-setting means of FIG. 18 and FIG. 19, FIG. 21 a perspective and partially transparent view of the mode-setting means of FIG. 18 to FIG. 20, in the case of a first torque setting, FIG. 22 a perspective and partially transparent view of the mode-setting means of FIG. 18 to FIG. 20, in the case of a second torque setting, FIG. 23 a perspective and partially transparent view of the mode-setting means of FIG. 18 to FIG. 20 in the case of an operation of changing to a third torque setting, FIG. 24 a perspective and partially transparent view of the mode-setting means of FIG. 18 to FIG. 20, in the case of a third torque setting, FIG. 25 a longitudinal section through the hand-held power tool of FIG. 1, with the mode-setting means of FIG. 17, in the second operating mode, FIG. 26 a partially sectional and partially perspective view of the mode-setting means of FIG. 17 in the second operating mode, as viewed from a first viewing angle, FIG. 27 a partially sectional and partially perspective view of the mode-setting means of FIG. 17 in the second operating mode, as viewed from a second viewing angle, FIG. 28 a front view of the mode-setting means of FIG. 17, as viewed in the direction of the drive motor, FIG. 29 a partially transparent side view of the mode-setting means and of the transmission of FIG. 17, in the second operating mode, FIG. 30 a partially transparent side view of the mode-setting means and of the transmission of FIG. 17, in the case of an operating of changing to a third operating mode, FIG. 31 a partially transparent side view of the mode-setting means and of the transmission of FIG. 17, in the third operating mode, as viewed from a first viewing angle, FIG. 32 a top view of a mode indicator element assigned to the mode-setting means of FIG. 17, according to a further embodiment, FIG. 33 a partially transparent side view of the mode-setting means and of the transmission of FIG. 17, in the third operating mode, as viewed from a second viewing angle, FIG. 34 a longitudinal section through the hand-held power tool of FIG. 1, with the mode-setting means of FIG. 17, in the third operating mode, FIG. 35 a partially sectional and partially perspective view of the mode-setting means of FIG. 17, in the third operating mode, as viewed from a first viewing angle, FIG. 36 a partially sectional and partially perspective view of the mode-setting means of FIG. 17, in the third operating mode, as viewed from a second viewing angle, FIG. 37 a front view of the mode-setting means of FIGS. 35 and 26, in the third operating mode, as viewed in the direction of the rive motor, FIG. 38 a longitudinal section through the hand-held power tool of FIG. 1, with the mode-setting means of FIG. 17, in a fourth operating mode, FIG. 39 a partially sectional and partially perspective view of the mode-setting means of FIG. 17, in the fourth operating mode, as viewed from a first viewing angle, FIG. 40 a partially sectional and partially perspective view of the mode-setting means of FIG. 17, in the fourth operating mode, as viewed from a second viewing angle, and FIG. 41 a front view of the mode-setting means of FIG. 39 and FIG. 40, in the fourth operating mode, as viewed in the direction of the drive motor.

FIG. 1 shows an exemplary hand-held power tool 100, having a housing 110, arranged in which is at least one drive motor 120 for driving a, preferably replaceable, insert tool that can be arranged in a tool receiver 180. Preferably, there is a set of control electronics 140 assigned to the hand-held power tool 100, at least for controlling the drive motor 120. For the purpose of illustration, the tool receiver 180 is realized as a chuck attachment having, as an example, three chuck jaws 182, 184, but it could also be realized as a quick-action chuck.

The housing 110 preferably has a handle 126, which has a hand switch 117. The drive motor 120 can be actuated, for example, via the hand switch 117, i.e. it can be switched on and off, and preferably can be electronically controlled, by open-loop or closed-loop control, in such a manner that both a reversing operating mode and selections for a desired rotational speed can be realized. In addition, preferably realized in the region of the hand switch 117 is a rotational-direction switch 116, which may optionally be used to set a direction of rotation of the drive motor 120, or of an output shaft (205 in FIG. 2) assigned to the drive motor 120. Furthermore, the hand-held power tool 100 can preferably be connected to an accumulator battery pack 130 for supply of electric power independently of a mains power supply, but alternatively may also be operated from a mains power supply.

The hand-held power tool 100 preferably has a gearshift transmission 150, which can be switched over at least between a first and a second gear step. Preferably, the transmission 150 is realized in the manner of a planetary gear. Preferably, the hand-held power tool 100 is realized in the manner of a percussive-drill/driver or drill/driver, the first gear step corresponding, for example, to a screwdriving mode, and the second gear step corresponding to a drilling and/or percussive drilling mode. According to one embodiment, the screwdriving mode is assigned to the first gear step, and the drilling mode and the percussive drilling mode are assigned to the second gear step.

Preferably, a mode-setting means 160 is used for setting the various operating modes. Preferably, an operating mode can be set by rotation of the mode-setting means 160 in the circumferential direction. In particular, in this case an operating-mode setting, a torque setting and/or a gear-change setting may be effected by rotation of the mode-setting means 160 in the circumferential direction. Assigned to the mode-setting means 160 in this case is a mode indicator element 170, which is designed to visualize a set operating mode, torque and/or gear step. For the purpose of illustration, the mode indicator element 170 is arranged on a top side of the housing 110, or on a side of the housing 110 opposite to the handle 126. However, the mode indicator element 170 could also be arranged at any other position on the hand-held power tool 100.

Figure 2:
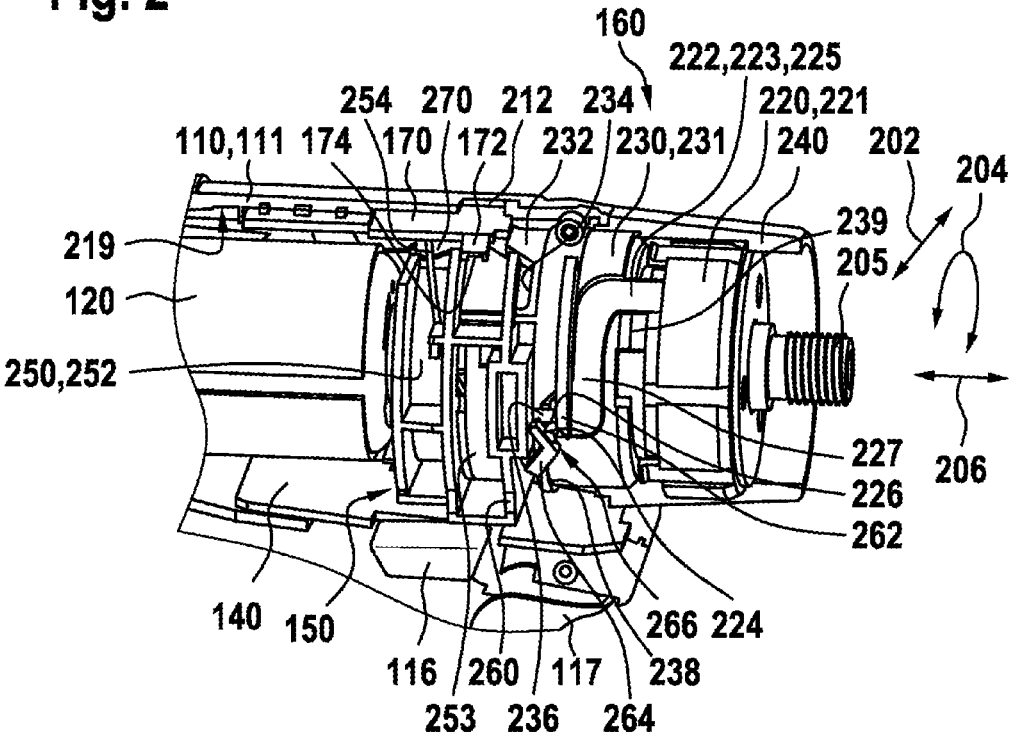

FIG. 2 shows the hand-held power tool 100 of FIG. 1, with the housing 110, arranged in which are the drive motor 120 and the transmission 150, which can be driven by the drive motor 120, for the purpose of driving an output shaft 205. The housing 110 preferably has two housing shells 111, only one of the two housing shells 111 being represented in FIG. 2, in order to illustrate the mode-setting means 160. Preferably, there is at least one rotatable actuating element 240, for setting an operating mode, one torque-setting element 220, for setting a torque, and/or one gear-changing element 230, for changing gears of the transmission 150, assigned to the mode-setting means 160.

The actuating element 240 is assigned to the mode-setting means 160 for the purpose of setting the various operating modes. Preferably, the actuating element 240 is rotatably connected to the mode-setting means 160, such that a rotation of the actuating element 240 in the circumferential direction 204 effects an operating-mode setting, a torque setting and/or a gear change. For the purpose of illustration, and preferably, the torque-setting element 220 is connected to the actuating element 240 in a rotationally fixed manner.

The torque-setting element 220 preferably has an annular basic body 221. On its side that faces toward the drive motor 120, the torque-setting element 220 preferably has a coupling element 222. Preferably, the mode-setting means 160 has the coupling element 222, which is arranged in a movable manner on the torque-setting element 220.

According to one embodiment, the coupling element 222 is preferably arranged in a pivotable manner on the torque-setting element 220. Preferably, the coupling element 222 is realized as an, in particular, elastic coupling arm 223. The coupling element 222 in this case is realized in the direction of the drive motor, or at least in the longitudinal direction 206 of the housing 110. For the purpose of illustration, and preferably, the coupling element 222 is realized in the longitudinal direction 206 of the housing 110 and in the circumferential direction 204 of the housing 110, the coupling element 222 having a first portion 225, realized in the longitudinal direction 206, and a second portion 227, realized in the circumferential direction 204. The coupling element 222, in particular the second portion 227, preferably has a coupling recess 226 for coupling to the gear-changing element 230. During coupling, the coupling recess 226 in this case preferably engages in a coupling projection 236 of the gear-changing element 230.

Furthermore, the coupling element 222 preferably has a guide element 224, preferably on the second portion 227. Preferably, the guide element 224 is realized in the radial direction 202 of the mode-setting means 160, or radially outward toward the housing 110. When the actuating element 240 is rotated, the guide element 224 in this case preferably acts in combination with a guideway 266, which is solid with the housing. The guideway 266 in this case is preferably realized, in the circumferential direction 204, on an inner face 219 of the housing 110. In particular, the guideway 266 is realized on an inner face 219 of a housing shell 111. Preferably, the guideway 266 is realized by at least two housing ribs that are solid with the housing. Preferably, the guideway 266 is realized by a guide web 262, that is solid with the housing, and a decoupling web 264.

The gear-changing element 230 preferably has an annular basic body 231, and is preferably rotatably mounted. The basic body 231 has a stepped region 238, at least in portions, the coupling arm 223 of the torque-setting element 220 being arrangeable in the stepped region 238. The basic body 231 additionally comprises the coupling projection 236, the coupling recess 226 of the torque-setting element 220 preferably engaging in the coupling projection 236 during coupling. Furthermore, at its end that faces toward the torque-setting element 220, the basic body 231 has at least one extension region 237, realized in the longitudinal direction 206 of the housing 110. The extension region 237 in this case is preferably realized as a deactivating element for an optional percussion mechanism (510 in FIG. 5), and is referred to in the following as "deactivating element 239". In addition, at its end that faces toward the drive motor 120, the gear-changing element 230, or the basic body 231, preferably has an extended region 232. The extended region 232 in this case preferably has a gate 234. A guide pin (374 in FIG. 3) of a loading element 270 is preferably arranged in the gate 234.

Preferably, the loading element 270 is designed to effect a gear change of the transmission 150 realized, for example, as a planetary transmission. The planetary transmission in this case is realized with a selector ring gear (547 in FIG. 5) that can be shifted by means of a selector bail 254. The loading element 270 in this case is designed to apply load to the selector bail 254, at least during a gear change. The selector bail 254 is preferably realized as a wire bail. The transmission 150 in this case is arranged in a transmission housing 250, which preferably has a first and a second transmission housing part 252, 253. For the purpose of illustration, the first transmission housing part 252 is arranged facing toward the drive motor 120, and the second transmission housing part 253 is arranged facing toward the torque-setting element 220.

Also preferably arranged in the gear-changing element 230 is the mode indicator element 170, which is moved in the longitudinal direction 206 of the housing 110 during setting of an operating mode, and which visualizes, or indicates, a respectively assigned operating mode. For the purpose of illustration, the housing 110 in this case has the housing shell 111, a recess 212 for visualizing the current operating mode. For the purpose of visualizing the current operating mode, the mode indicator element 170 has a guide region 172, which has a guide recess 174. In this case, a guide pin (332 in FIG. 3) assigned to the extended region 232 of the gear-changing element 230 can be arranged in the guide recess 174.

According to the disclosure, the torque-setting element 220 and the gear-changing element 230 are separably coupled to each other during a gear change. Furthermore, the torque-setting element 220 and the gear-changing element 230 are decoupled from each other during setting of a torque. In this case, during a gear change, the coupling element 222 preferably couples the torque-setting element 220 and the gear-changing element 230 in a separable manner. Furthermore, the coupling element 222 is preferably movably arranged on the torque-setting element 220 in such a manner that, during a gear change, the torque-setting element 220 is coupled to the gear-changing element 230 and/or, during setting of a torque, the torque-setting element 220 is decoupled from the gear-changing element 230.

Figure 3:
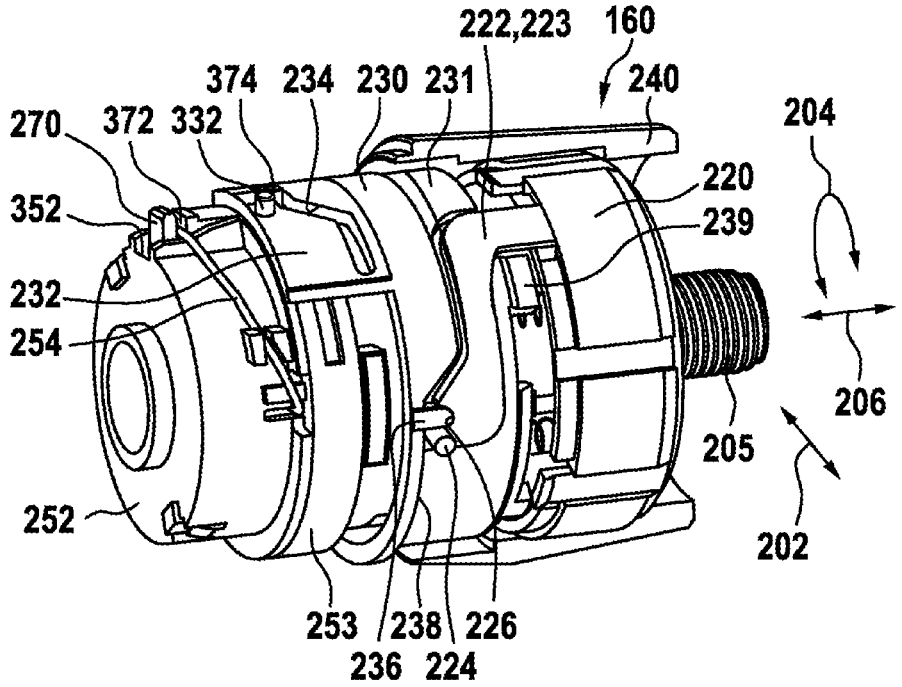

FIG. 3 shows the mode-setting means 160 of FIG. 2, with the torque-setting element 220 and the gear-changing element 230, and with the exemplary planetary transmission 150 arranged in the transmission housing 250. FIG. 3 in this case illustrates the coupling projection 236 of the basic body 231, the coupling recess 226 of the torque-setting element 220 being arranged on the coupling projection 236. Also illustrated in FIG. 3 is a guide pin 332, which is assigned to the extended region 232 of the gear-changing element 230 and which can be arranged in the guide recess 174 of the mode indicator element 170.

FIG. 3 also shows a guide pin 374 of the loading element 270 that is arranged in the gate 234. The loading element 270 in this case is arranged in a receiver 352 of the first transmission housing part 252. Preferably, the loading element 270 has a recess 372 for arrangement of a portion of the selector bail 254.

Figure 4:
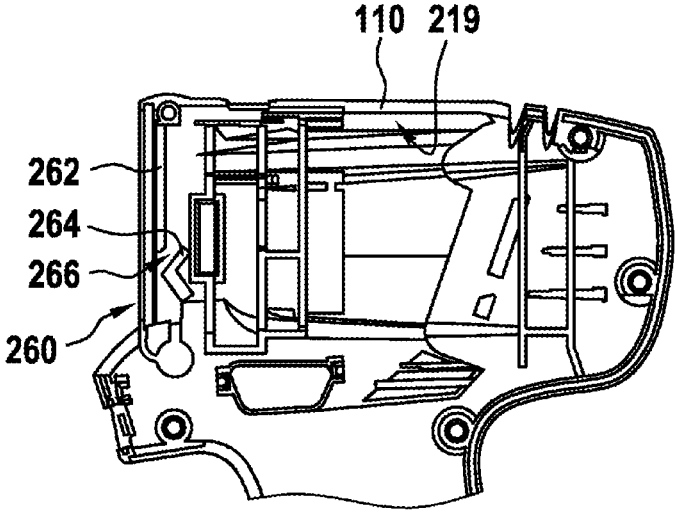

FIG. 4 shows one of the preferably two housing shells 111 of the housing 110 of the hand-held power tool 100 of FIG. 1. FIG. 4 in this case illustrates a guideway 266 preferably realized, in the circumferential direction 204 of the housing 110, on the inner face 219 of the housing 110, or of the housing shell. Also illustrated in FIG. 4 is the housing rib 260, as well as the guide web 262 that is solid with the housing, and the decoupling web 264, which form the guideway 266.

Figure 5:
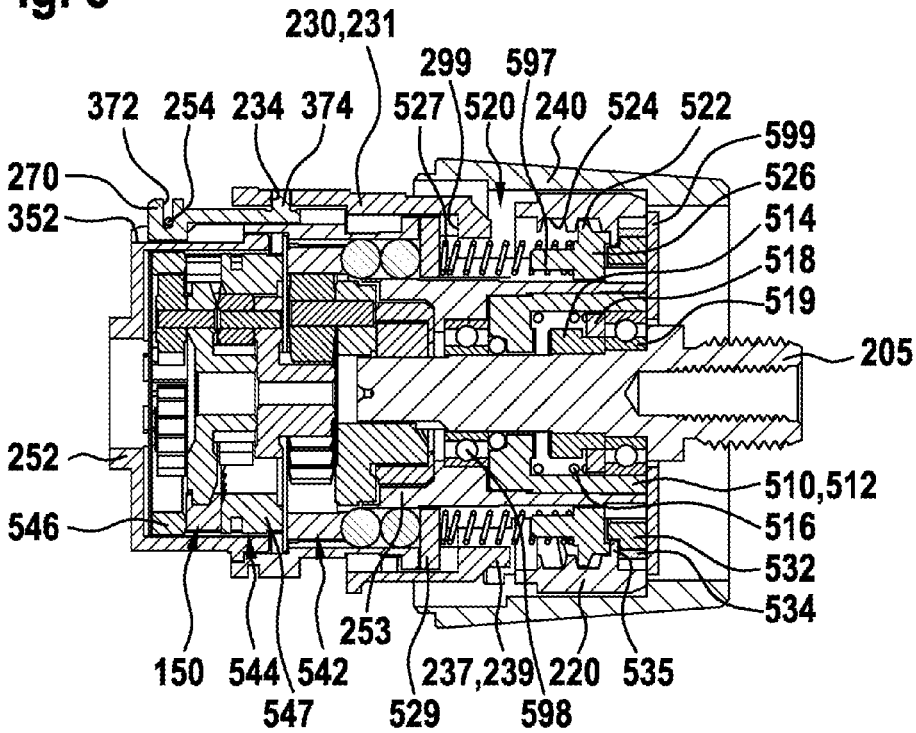

FIG. 5 shows the mode-setting means 160 of FIG. 3, with the torque-setting element 220 and the gear-changing element 230, and with the transmission 150. FIG. 5 in this case illustrates the gearshift transmission 150 of FIG. 1 and FIG. 2, preferably realized as a planetary transmission, for driving the output shaft 205 of the hand-held power tool 100 of FIG. 1. The planetary transmission 150 preferably has at least one first and second, illustratively one first second and third, planetary stage 542, 544, 546 which, illustratively, enable the planetary transmission 150 to be operated in a first and a second gear step. Preferably in this case, as described above, each gear step is assigned to a corresponding operating mode, e.g. to a screwdriving mode, a drilling mode and/or a percussive drilling mode/percussive screwdriving mode. For example, a screwdriving mode may be provided for executing a screwdriving operation with torque limitation in a first gear step, while a drilling operation and/or a drill/driving operation with percussive function is provided for execution in a second gear step, etc.

Preferably, the planetary transmission 150 has an axially displaceable selector element 547, which is preferably realized as a selector ring gear, and which in the following is referred to as "selector ring gear 547". The selector ring gear 547 is preferably displaceable between at least two axial positions, an axial position in each case being assigned to a gear step. According to one embodiment, the selector ring gear 547 is realized as an internal ring gear of the second planetary transmission state, but alternatively the selector ring gear 547 may also be realized as an additional selector ring gear of the planetary transmission 150. Since the basic structure and functioning of planetary transmissions is sufficiently known to persons skilled in the art, to simplify the description the transmission 150 is not described in detail here.

During a gear change, the gear-changing element 230 is preferably rotated, as a result of which, preferably, the guide pin 374 of the loading element 270 moves along the gate 234. The loading element 270 in this case is moved axially, as a result of which the selector bail 254 moves the selector ring gear 547, or a gear change is effected.

Also illustrated in FIG. 5 is an optional percussion mechanism 510, illustratively realized as a notching percussion mechanism, which can preferably be activated in the percussive drilling mode. It is pointed out, however, that the design of the percussion mechanism 510 as a notching percussion mechanism is merely an example, and is not to be regarded as a limitation of the disclosure. Thus, the percussion mechanism 510 may also be realized as any other percussion mechanism, e.g. as a nutating percussion mechanism. A locking element 518 is provided for activating and/or deactivating the percussion mechanism 510, or a corresponding percussive drilling mode. Preferably, in the screwdriving mode and/or drilling mode, load is applied to the locking element 518 by deactivating elements 239 of the gear-changing element 230, at an end of the gear-changing element 230 that faces toward the drive shaft 205. In a percussive drilling mode, the locking element 518 can be moved in the axial direction, and the percussion mechanism 510 is activated.

Preferably, at least in an operating mode, the gear-changing element 230 is coupled to the transmission element 529, which is mounted on the transmission housing part 253. In a screwdriving position assigned to the screwdriving mode, the transmission element 529 is preferably mounted in an axially displaceable manner on the transmission housing part 253, and in the percussive drilling and drilling positions assigned to the percussive drilling mode and drilling mode it is axially fixed on the transmission housing part 253.

According to one embodiment, the transmission element 529 is realized in the form of a disk, in the manner of a pressure disk, or pressure plate, and is referred to in the following as "pressure plate 529". Preferably in this case, the pressure plate 529 bears, with its side that faces toward the output shaft 205, against the transmission housing part 253. Preferably, the pressure plate 253 is connected to the transmission housing part 253 in a rotationally fixed manner.

In addition, the mode-setting means 160, in particular the gear-changing element 230, preferably has at least one blocking element 299, via which, in the percussive drilling mode or drilling mode, the pressure plate 529 is fixed axially, in the assigned percussive drilling or drilling position, on the transmission housing part 253. In the screwdriving mode, the at least one blocking element 299 preferably releases the pressure plate 529 in the axial direction. Preferably, the at least one blocking element 299 is arranged on a side of the gear-changing element 230 that faces toward the torque-setting element 220, or the output shaft 205. Preferably, the at least one blocking element 299 is realized as a single piece with the gear-changing element 230.

According to one embodiment, the hand-held power tool 100 has an optional torque-limiting unit 520. The optional torque-limiting unit 520 is preferably assigned to the torque-setting element 220. Preferably, in the first operating mode, preferably the screwdriving mode of the hand-held power tool 100, the torque-limiting unit 520 is activated, since in the screwdriving mode the transmission element 529 is preferably released, and can thus be moved axially. In this case, the transmission element 529 is preferably coupled to the torque-limiting unit 520. If the maximally transmissible torque set by the torque-limiting unit 520, in particular the torque-setting element 220, is exceeded, the transmission element 529 moves axially, and decouples the transmission 150 from the output shaft 205.

Preferably, a maximally transmissible torque can be set by means of the torque-setting element 220, or the actuating element 240. For this purpose, the torque-setting element 220 is preferably connected to the actuating element 240 in a rotationally fixed manner. Furthermore, the torque-setting element 220 is preferably fixed in position axially on the transmission housing part 253. In addition, for the purpose of setting the maximally transmissible torque, the torque-setting element 220 preferably has an internal thread 524, which engages in an external thread 522 of a spring holder 526. The spring holder 526 preferably has at least one holding portion 597, which is preferably realized in the direction of the transmission 150. The at least one holding portion 597 is designed for arrangement of at least one spring element 527. The at least one spring element 527 is designed to apply load to the transmission element 529. Preferably, if the set, maximally transmissible torque is exceeded, the at least one spring element 527 becomes compressed, such that the transmission element 529 can move axially and preferably can decouple the transmission 150.

The spring holder 526 is preferably seated in a rotationally fixed, but axially movable, manner on the transmission housing part 253. This is effected, for example, by means of screws, which connect a holding plate 599 to the transmission housing part 253. The holding plate 599 preferably encompasses the output shaft 205, and loads a latching spring holder 532 against an annular shoulder 535 in the torque-setting element 220. The torque-setting element 220 is thus preferably also secured axially on the transmission housing part 253. In order that the torque-setting element 220, when being rotated for the purpose of setting a maximally transmissible torque, latches into discrete latching positions, load is preferably applied to it by a latching spring element 534. The latching spring element 534 is preferably held on the latching spring holder 532. The latching spring holder 532 and the latching spring element 534 are preferably arranged in an internal space encompassed by the torque-setting element 220. The latching spring element 534 preferably latches into discrete angular positions, e.g. in that the latching spring element 534 applies load to a latching contour on an inner side of the torque-setting element 220 that faces toward the output shaft 205.

An axial positioning movement shifts the output shaft 205 preferably between a percussive drilling position and a drilling or screwdriving position. For the purpose of illustration in FIG. 5, In the percussive drilling position the output shaft 205 can be displaced to the left, i.e. into the transmission housing part 253. The latching cup 512 in this case preferably comes into latching engagement with a latching disk 514 that is preferably seated in a rotationally fixed manner on the circumferential surface of the output shaft 205 and that, together with the latching cup 512, forms a latching mechanism. The latching disk 514 additionally performs the function whereby the ball bearing 519, which is likewise seated on the circumferential surface of the output shaft 205, is axially fixed thereon. Preferably arranged within the latching cup 512 is a spring element 516 which, via the locking element 518 and the ball bearing 519, forces the output shaft 205 into an assigned non-latched position, in which the latching cup 512 and the latching disk 514 are not in engagement.

Figure 6:
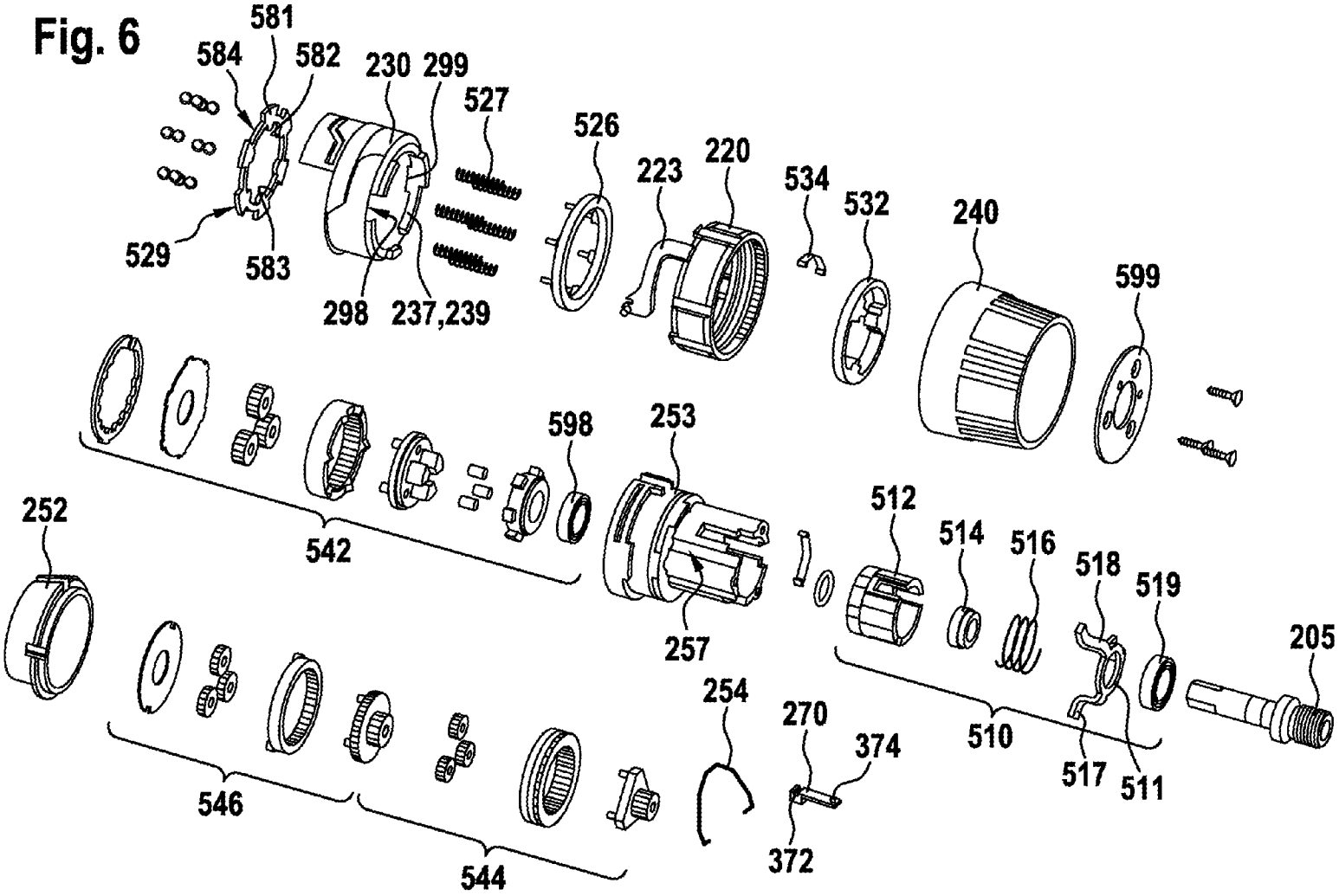

FIG. 6 shows the mode-setting means 160 of FIGS. 2 and 3, with the torque-setting element 220 and the gear-changing element 230, and with the transmission 150. FIG. 6 in this case illustrates the transmission element 529 realized as a pressure plate. The pressure plate 529 preferably has an annular basic body. Preferably, there are radially inward portions 582 realized on an inner circumference of the pressure plate 529. Preferably, between each two adjacent portions 582 there is a portion 583, the portions 582 each being realized so as to be further radially inward than the portions 583. The portions 582 are each preferably designed for arrangement in a respective recess 257 of the second transmission housing part 253. This results in the pressure plate 529 being arranged such that, preferably, it is fixed in the circumferential direction, but is axially movable. The recess 257 is arranged on an outer side of the second transmission housing part 253. In this case, there is one recess 257 assigned to each portion 282.

In addition, the pressure plate 257 has, on its outer surface, radially outward projections 581, with a receiving region 584 realized between two projections 581. As described above, the gear-changing element 230 preferably has at least one, illustratively and preferably three, blocking elements 299, with a receiver 298 being realized between each two blocking elements 299. In the percussive drilling mode or drilling mode, the blocking elements 299 preferably fix the pressure plate 529 axially on the transmission housing part 253, there being one projection 581 positioned at one blocking element 299 in each case. In the screwdriving mode, the blocking elements 299 preferably release the pressure plate 529 in the axial direction. The projections 281 in this case are arranged in the receivers 298, and the pressure plate 529 can be moved axially, with the result that the torque-limiting unit 520 is activated.

Furthermore, FIG. 6 illustrates the latching spring element 534, which is assigned to the latching spring holder 532. As described above, the latching spring element 534 preferably applies load to the torque-setting element 220, as it is being rotated for the purpose of setting a maximally transmissible torque, in the discrete latching positions.

Additionally illustrated in FIG. 6 is the locking element 518, which has an annular basic body 511, which is designed for arrangement of the locking element 518 on the output shaft 205. At least one, illustratively three, limb(s) 517, realized radially outward, is/are arranged on the basic body 511. Such a locking element 518 is also known as a so-called tripod. In the screwdriving and/or drilling mode, load is applied to the locking element 518 by the deactivating element 239 of the gear-changing element 230, and axial movement of the locking element 518 is prevent, with the result that the percussion mechanism 510 is deactivated. In the percussive drilling mode, the locking element 518, or the limbs 517, is/are arranged in the receivers 298, and is thus axially movable, such that the percussion mechanism 510 is activated.

Figure 7:
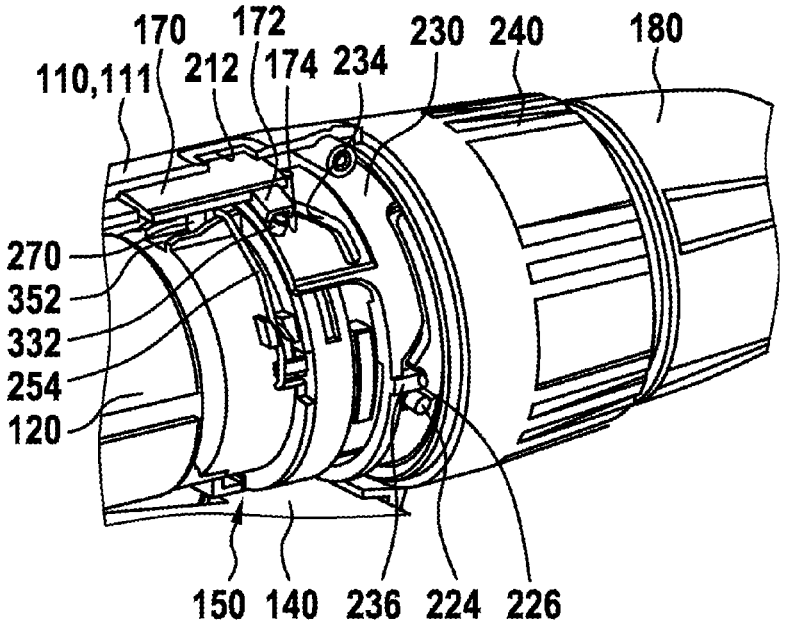

FIG. 7 shows the hand-held power tool 100 of FIG. 1 with an opened housing 110, or with only one housing half 111, in the first operating mode. Preferably, the first operating mode is a screwdriving mode. Illustrated in FIG. 7 in this case is the coupling projection 236 of the gear-changing element 230, which is arranged in the coupling recess 226. In this case, according to FIG. 7, a first gear step of the transmission 150 is active.

Figure 8:
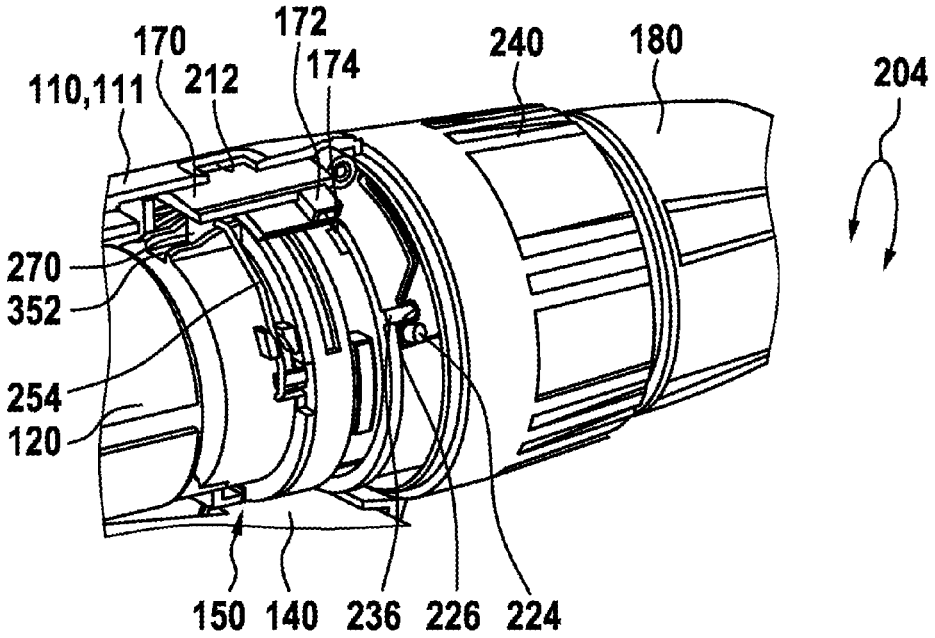

FIG. 8 shows the hand-held power tool 100 of FIG. 7 in a further operating mode. For the purpose of illustration, in FIG. 8 the gear-changing element 230 has been rotated in the circumferential direction 204 relative to FIG. 7. Preferably, the operating mode shown is a drilling or percussive drilling mode, in which a second gear step of the transmission 150 is activated. Illustrated in FIG. 8 in this case is the guide pin 332 arranged in the guide recess 174 of the mode indicator element 170.

Figure 9:
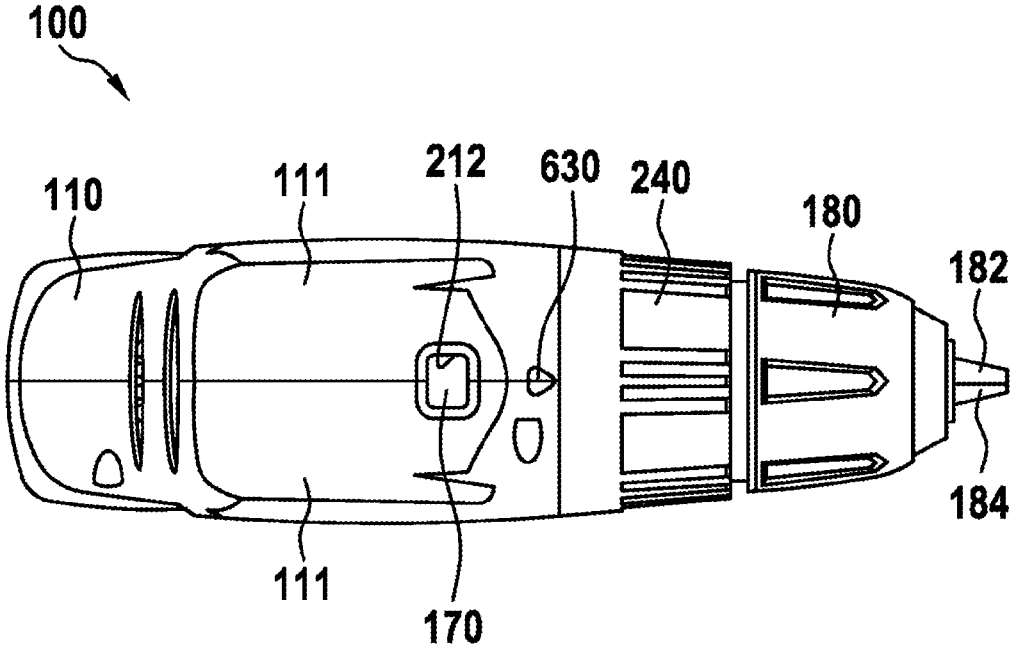

FIG. 9 shows the hand-held power tool 100 of FIG. 1 as viewed from above, and illustrates the recess 212 for visualizing the current operating mode. Furthermore, FIG. 9 shows a marking 630 for visualizing a current operating mode on the actuating element 240. Illustratively, the marking 630 is realized as a triangle, but it could also be of any other shape.

Figure 10:
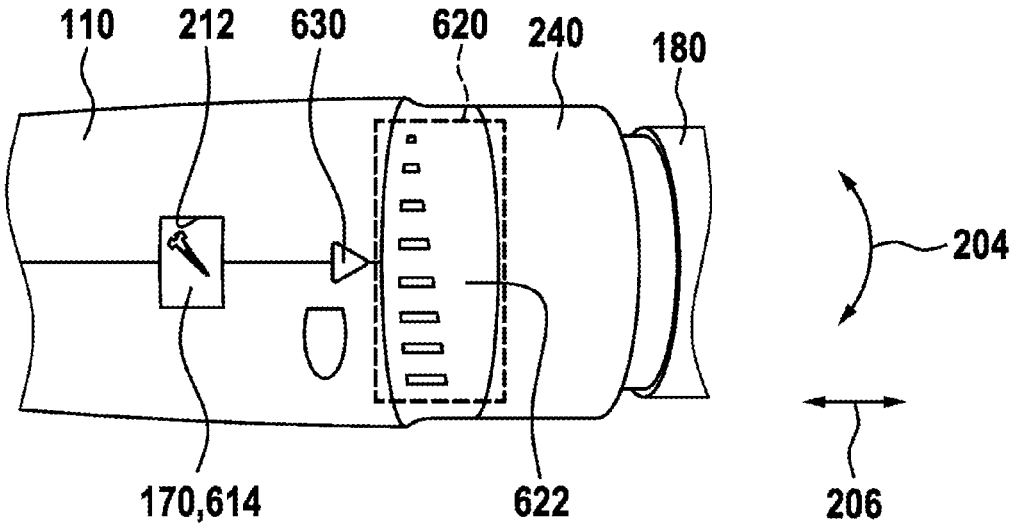

FIG. 10 shows the hand-held power tool 100 of FIG. 9 in a screwdriving mode. In this case, an exemplary screw symbol 614, which is assigned to the screwdriving mode, is visualized by the mode indicator element 170 through the recess 212. Furthermore, on its outer circumference, the actuating element 240 preferably has a setting marking 620. The setting marking 620 preferably has a first setting region 622 for setting a maximally transmissible torque. The torque setting region 622 is preferably visualized by lines that increase in size in the circumferential direction 204. It is pointed out, however, that a settable torque quantity may be visualized in a different manner, e.g. by torque values in the form of numerical values.

Figure 11:
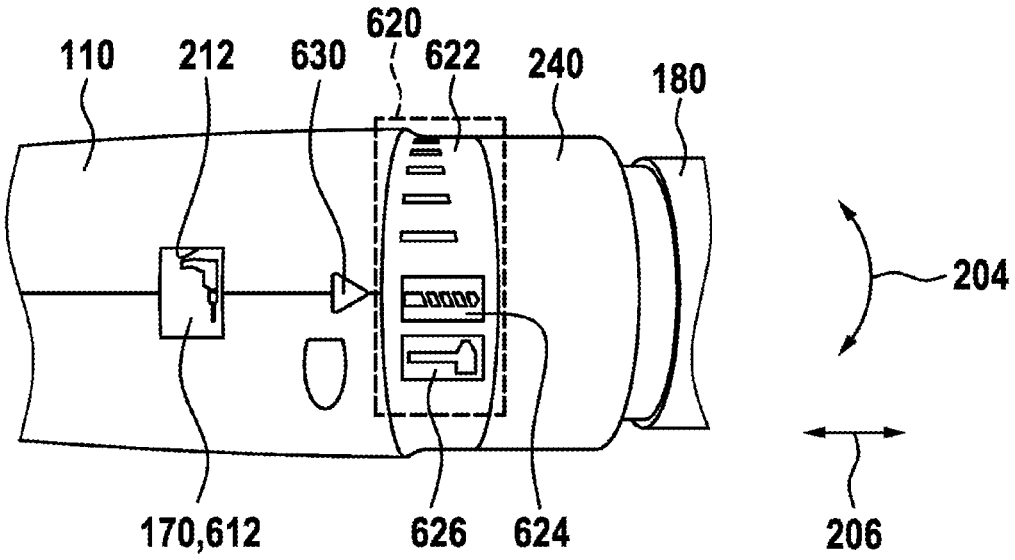

FIG. 11 shows the hand-held power tool 100 of FIG. 9 and FIG. 10 in a second operating mode, realized as a drilling mode. In this case, an exemplary drill symbol 612, which is assigned to the drilling and/or percussive drilling mode, is visualized by the mode indicator element 170 through the recess 212. Furthermore, on its setting marking 620, the actuating element 240 has a setting region 624 assigned to the optional drilling mode. The setting region 624 visualizes the drilling mode by a drill bit symbol. In addition, FIG. 11 shows, assigned to the actuating element 240, a further optional setting region 626, which is assigned to the percussive drilling mode. The setting region 626 visualizes the percussive drilling mode by a hammer symbol. It is pointed out that the differing setting regions 622-626 may also be visualized by any other symbols, e.g. by letters.

Figure 12:
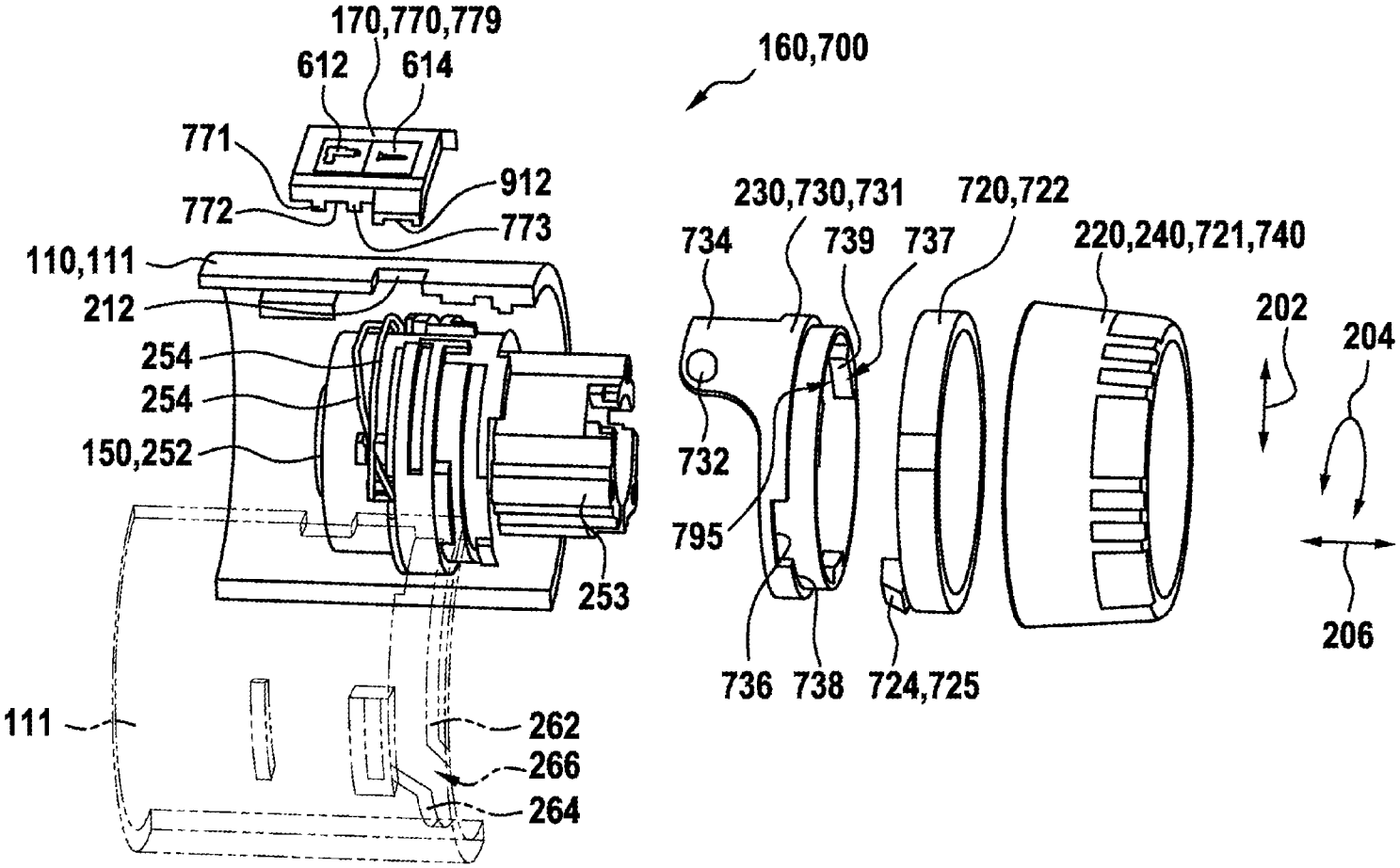

FIG. 12 shows the mode-setting means 160 of FIG. 1 to FIG. 8, realized according to a further embodiment and referred to in the following as mode-setting means 700. As with the mode-setting means 160 of FIG. 2 to FIG. 11, an actuating element 740 comprising a torque-setting element 721, a gear-changing element 730 and a mode indicator element 770 are assigned to the mode-setting means 700. It is pointed out that identical components of the two embodiments of the hand-held power tool 100 having the mode-setting means 160, or 700, are denoted by the same reference numbers. For example, the transmission 150 of FIG. 1 to FIG. 11, which is preferably realized as a planetary transmission, is also used in the embodiment of the mode-setting means 700 shown in FIG. 12.

Furthermore, as with the torque-setting element 220 of FIG. 2 to FIG. 11, preferably assigned to the torque-setting element 721 is a coupling element 720, which preferably has a guide element 725 that acts in combination with the guideway 266 of the housing 110, or of the housing shell 111, as the actuating element 740 is being rotated. As with the guide element 24, the guide element 725 in this case is realized in the radial direction 202 of the mode-setting means 700.

According to the embodiment shown in FIG. 12, the coupling element 720 is realized as a coupling ring 722. Preferably in this case, the guide element 725 and/or a coupling projection 724 are/is assigned to the coupling ring 722. As with the coupling projection 236 of the gear-changing element 230 of FIG. 2 to FIG. 11, during coupling the coupling projection 724 preferably engages in a coupling recess 736 of the gear-changing element 730. Preferably, the coupling projection 724 is realized in the manner of a parallelogram, but may also be of any other shape. Moreover, the guide element 725 and the coupling projection 724 are preferably realized as a single piece, with the coupling ring 722, the guide element 725 and the coupling projection preferably being realized as a single piece. In this case, the coupling element 720 is preferably arranged in an axially movable manner on the torque-setting element 721. Preferably, in the embodiment shown in FIG. 12, the torque-setting element 721 and the actuating element 740 are realized as a single piece.

Preferably, the gear-changing element 730 has an annular basic body 731, and is preferably rotatably mounted. The basic body 731 has a stepped region 738, at least in portions, the coupling ring 722 being arrangeable in the stepped region 738. In addition, the basic body 731 has the coupling recess 736. Preferably, the coupling recess 736 is rectangular, but may also be of a different shape, assigned to the coupling projection. Furthermore, at its end that faces toward the coupling ring 720, the basic body 731 has at least one region 737 realized in the longitudinal direction 206 of the housing 110. The region 737 is preferably realized as a deactivating element for the percussion mechanism 510, and is referred to in the following as "deactivating element 739". In addition, or optionally, the region 737 has at least one blocking element 795, which is designed to release the pressure plate 529 in the axial direction in the screwdriving mode, as a result of which, preferably, the torque-limiting unit 520 becomes activated. In addition, the gear-changing element 730, or the basic body 731, at its end that faces toward the transmission 150, has an extended region 734 realized in the longitudinal direction 206 of the housing 110. The extended region 734 has a guide pin 732. The mode indicator element 770 preferably has a guide groove 912, the guide pin moving the mode indicator element 770 along the guide groove 912 during setting of an operating mode. In this case, during setting of an operating mode, the mode indicator element 770 is moved in the longitudinal direction 206 of the housing 110, and preferably visualizes a respectively assigned operating mode. For the purpose of visualizing a set operating mode, the mode indicator element 770 has, for example, the drill symbol 612 of FIG. 11 for visualizing a drilling mode, and the screw symbol 614 of FIG. 10 for visualizing a screwdriving mode.

According to the embodiment of FIG. 12, the mode indicator element 770 has an assigned loading element 779, which is designed to apply load to the selector bail 254 of the planetary transmission 150 during a gear change, and thus to effect a gear change. The loading element 779 preferably has two loading webs 771, 773, which form a recess 772 for arrangement of the selector bail 254. In this case, load is applied to the selector bail 254 by one of the two loading webs 771, 773 only during a gear change. Load is not applied to the selector bail 254 during operation of the hand-held power tool 100. Preferably, the mode indicator element 770 is realized as a loading element 779 for applying load to the selector bail 254, and/or for displaying the set operating mode.

Figure 13:
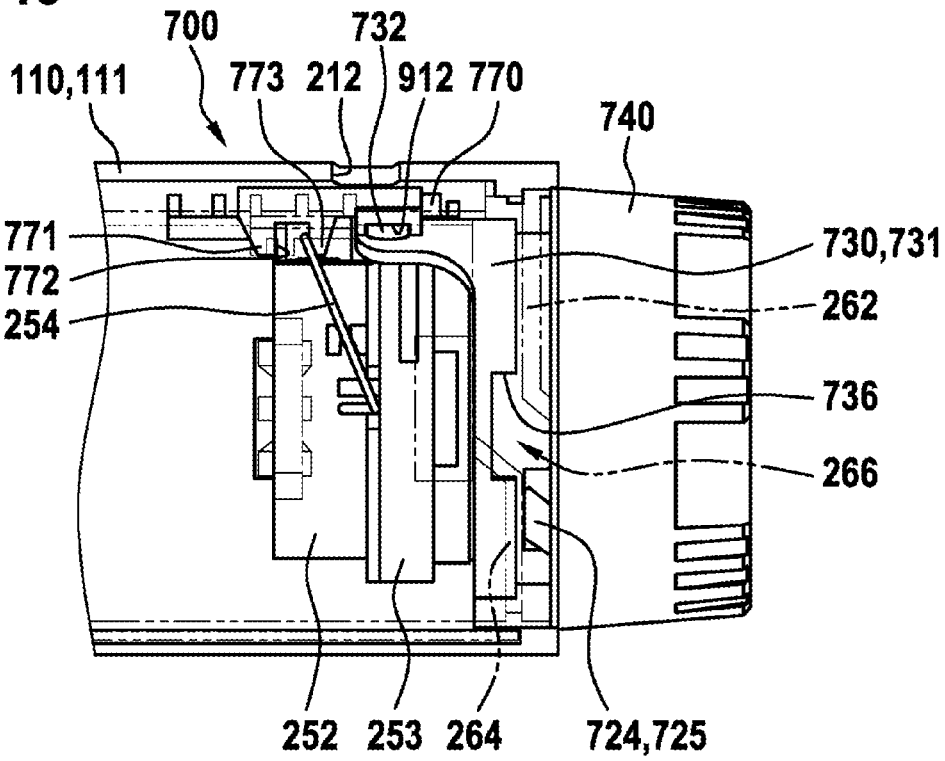

FIG. 13 shows the mode-setting means 700 of FIG. 12 in a screwdriving mode, in which the coupling projection 724 of the coupling ring 720 is arranged outside of the coupling recess 736 of the gear-changing element 730. Furthermore, FIG. 13 illustrates the guide pin 732 arranged in the guide groove 912 of the mode indicator element 770. In addition, in the screwdriving mode, the selector bail 254 is arranged in the recess 772, and bears against the loading web 773 shown, illustratively, on the right.

Figure 14:
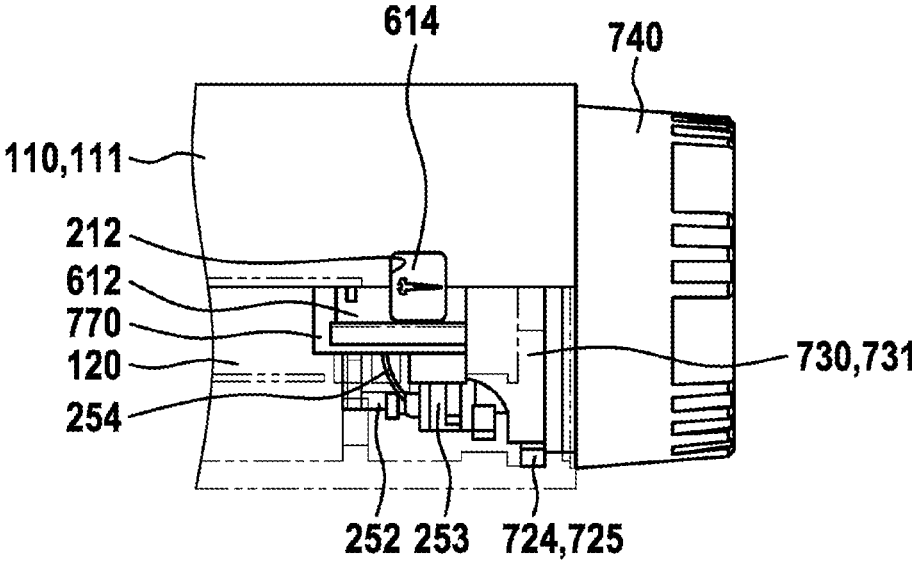

FIG. 14 shows the mode-setting means 700 of FIG. 13 in the screwdriving mode, as viewed from above. FIG. 14 in this case illustrates the visualization of the screwdriving mode by the screw symbol 614, which is visible through the recess 212 arranged in the housing shell 111.

Figure 15:
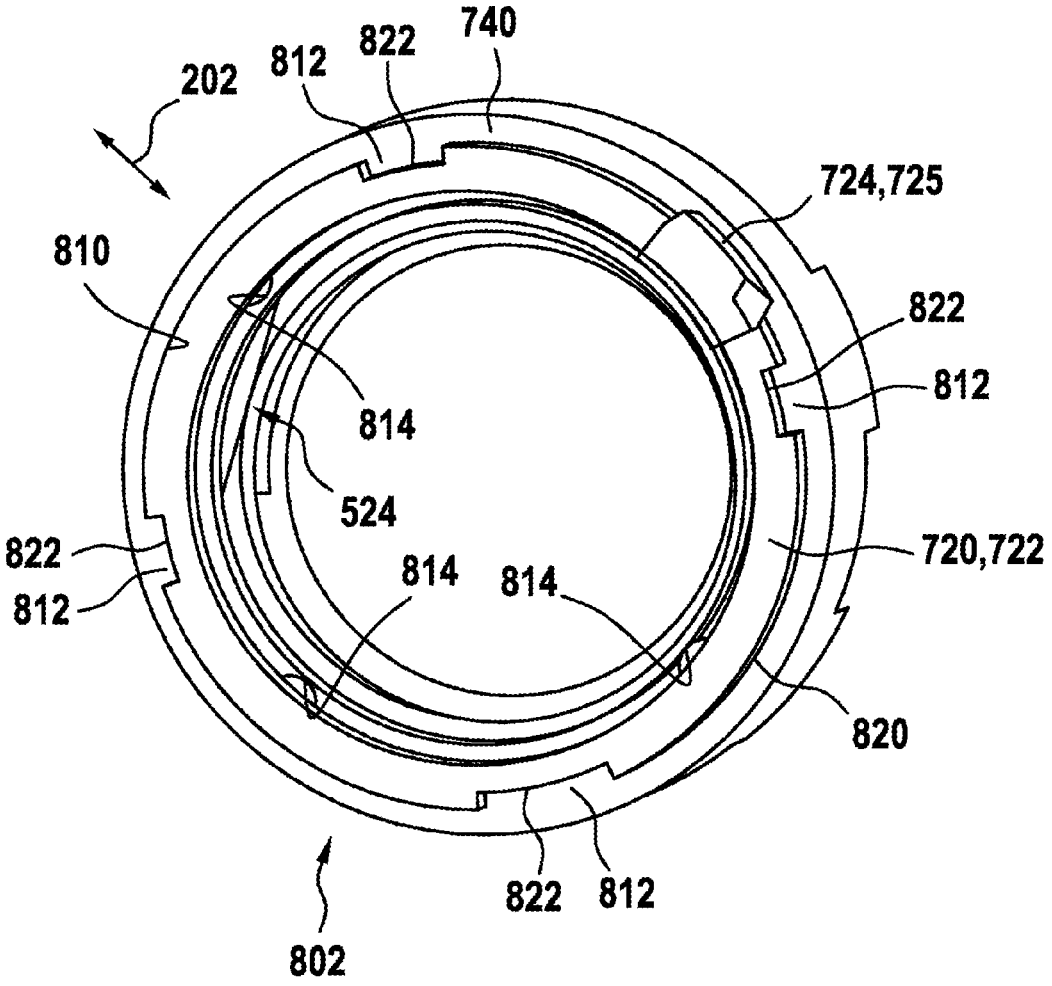

FIG. 15 shows the preferably annular actuating element 740 of FIG. 12, with the preferably integrated torque-setting element 721 and the coupling ring 720 of FIG. 12 to FIG. 14 arranged in the actuating element 740. FIG. 15 in this case illustrates the actuating element 740 preferably realized as a single-piece with the torque-setting element 721, with the internal thread 524, assigned to the torque-setting element 721, for setting the maximally transmissible torque being realized on an internal diameter of the actuating element 740. A direct torque setting can thus be effected.

Preferably, on its side 802 that faces toward the gear-changing element 730, the actuating element 740 has a receiver 810 for arrangement of the coupling ring 720. In this case the actuating element 740, or the receiver 810, preferably has at least one, illustratively four, rotation driving web(s) 812, which act in combination with assigned rotation receivers 822 of the coupling ring 720. The rotation receivers 822 in this case are realized on an outer circumference 820 of the coupling ring 720. Preferably, the rotation driving webs 812 have a rectangular shape, but may also be of any other shape assigned to the rotation receivers 822. Furthermore, the actuating element 740, or the receiver 810, has at least one, illustratively three, recess(es) for arrangement of a spring element, not represented. The spring element in this case is designed to force the coupling ring 720 radially outward, or to force the rotation driving webs 812 into the rotation recess 822. Preferably in this case, the recesses 814 are arranged on a side of the receiver 810 that faces toward the inner circumference of the actuating element 740, and the rotation driving webs 812 are preferably arranged on a side of the receiver 810 that faces toward the outer circumference of the actuating element 740.

Figure 16:
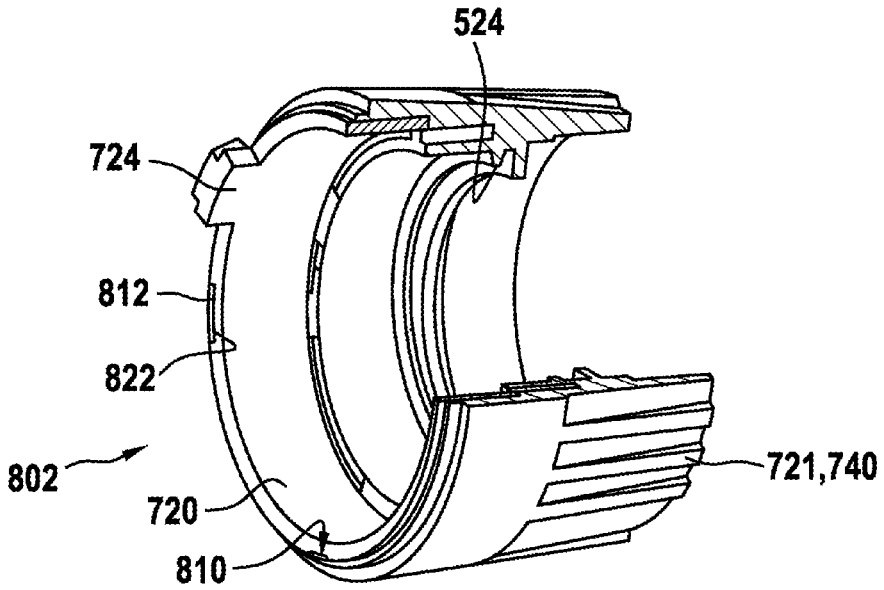

FIG. 16 shows the actuating element 740 of FIG. 15, with the torque-setting element 721 and the coupling ring 720. FIG. 16 in this case illustrates the internal thread 524 of the torque-setting element 721. Furthermore, FIG. 16 illustrates the arrangement of the coupling ring 720 in the receiver 810 of the actuating element 740.

Figure 17:
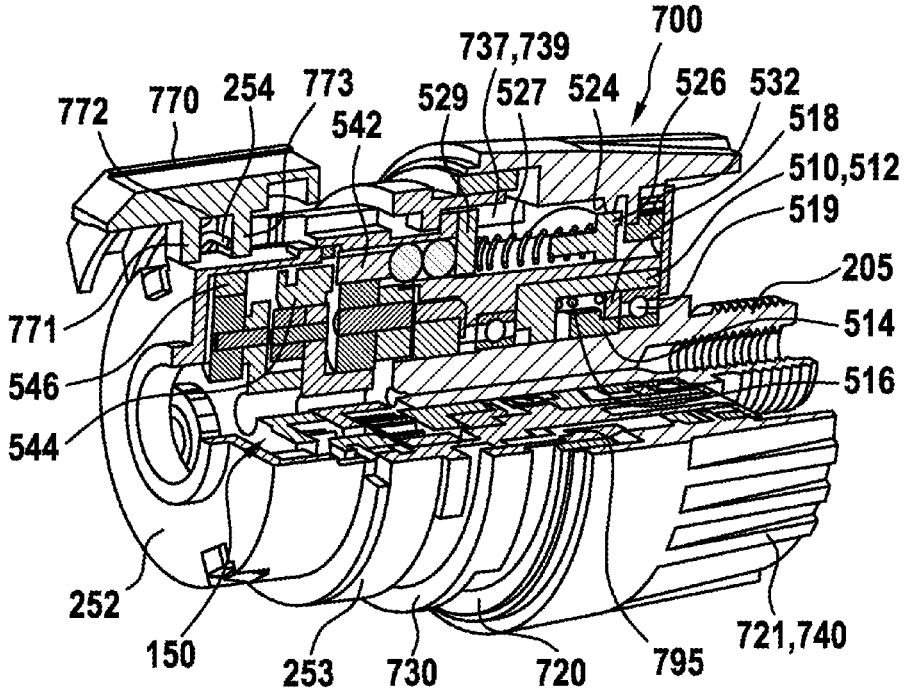

FIG. 17 shows the mode-setting means 700 of FIG. 12, with the planetary transmission 150 of FIG. 5, in a first gear step. FIG. 17 in this case illustrates the selector bail 254, arranged in the recess 772, which, for the purpose of illustration, bears against the loading web 773 on the right. Furthermore, FIG. 17 illustrates the internal thread 524 of the torque-setting element 721 engaging in the external thread 522 of the spring holder 526.

Figure 18:
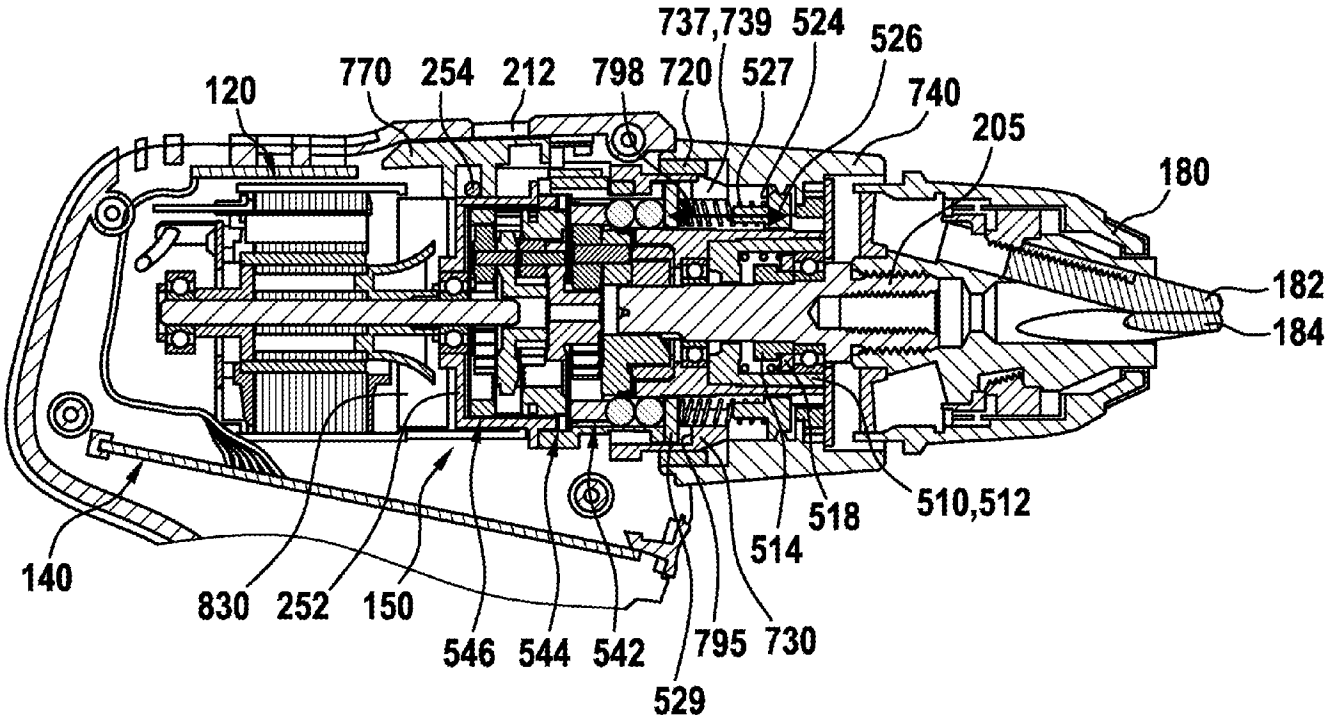

FIG. 18 shows the hand-held power tool 100 of FIG. 1, with the mode-setting means 700 of FIG. 12 to FIG. 17, in the screwdriving mode. FIG. 18 in this case illustrates the pressure plate 529 that is axially movable in the screwdriving mode, the at least one blocking element 795 releasing the pressure plate 529 and thus activating the torque-limiting unit 520. The pressure plate 529 in this case can move, in the direction of a double arrow 798, in the axial direction, contrary to a spring force of the spring elements 527 assigned to the spring holder 526. Thus, as described above, if the maximally transmissible torque is exceeded, the transmission 150 can be decoupled from the output shaft 205. In addition, FIG. 18 shows an optional fan 830 which, preferably and exemplarily, is arranged between the drive motor 120 and the transmission 150. However, the fan 830 could also be arranged at any other location, e.g. at an end of the drive motor 120 that faces away from the transmission 150.

Figure 19:
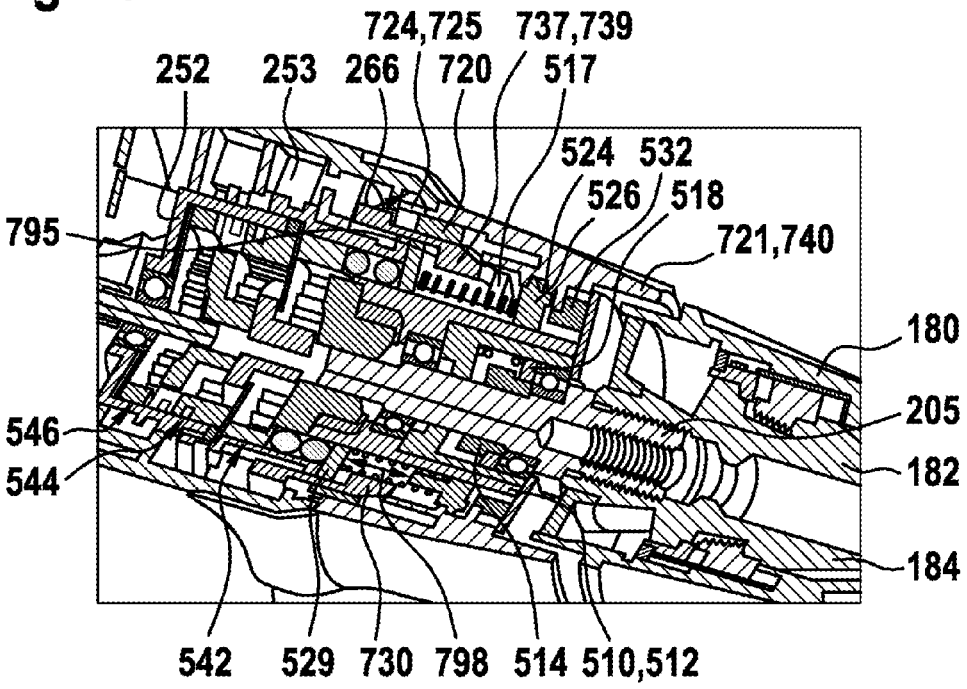

FIG. 19 shows the hand-held power tool 100 of FIG. 18 in the screwdriving mode, and illustrates the guide element 266 of the housing 110 that is arranged in the guideway 266 of the housing 110, or of the housing shell 111, that is solid with the housing. In addition, FIG. 19 shows a limb 517, which is assigned to the locking element 518 and to which, in the screwdriving mode shown in FIG. 19, load is applied by the deactivating element 739 of the gear-changing element 730. Axial movement of the locking element 518 is thereby prevented, as a result of which the percussion mechanism 510 is deactivated. FIG. 19, likewise, shows the pressure plate 529 that is movable axially in the direction of the double arrow 798.

Figure 20:
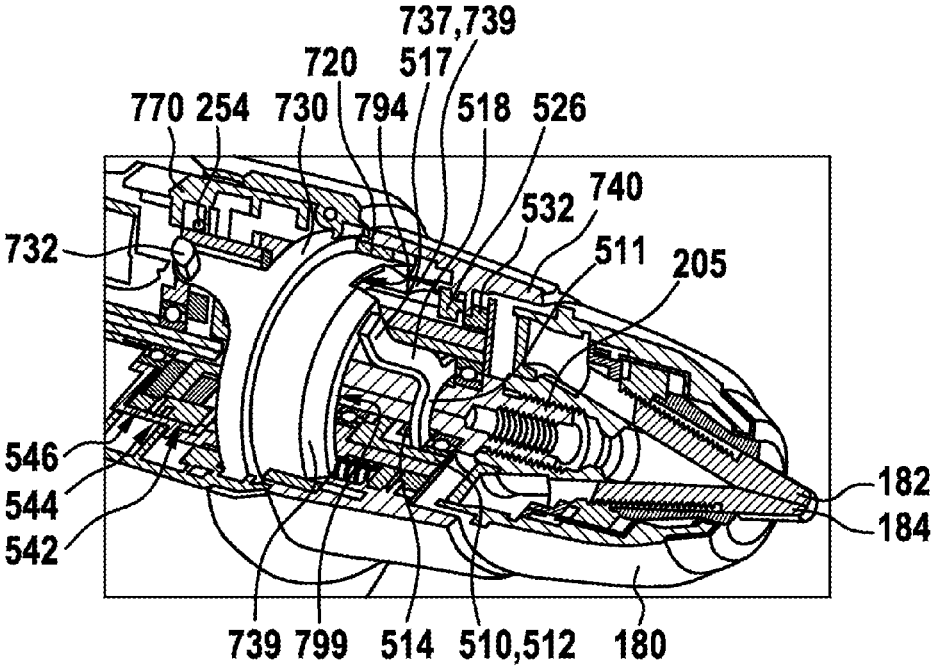

FIG. 20 shows the hand-held power tool 100 of FIG. 18 and FIG. 19, and illustrates the percussion mechanism 510. The locking element 518 is arranged, with its annular basic body 511, on the output shaft 205, and illustratively load is applied to one of the preferably three limbs 517 by the deactivating element 739 of the gear-changing element 730. The limb 517 in this case is positioned on a side 799 of the gear-changing element 730 that faces away from the transmission 150. Furthermore, FIG. 20 illustrates the gear-changing element 730, having the at least one, illustratively two, preferably three, blocking element(s) 795, with a receiver 794 preferably being realized between each two blocking element 795. Preferably, in the percussive drilling mode, the locking element 518, or the limbs 517, is/are arranged in the receivers 794.

Figure 21:
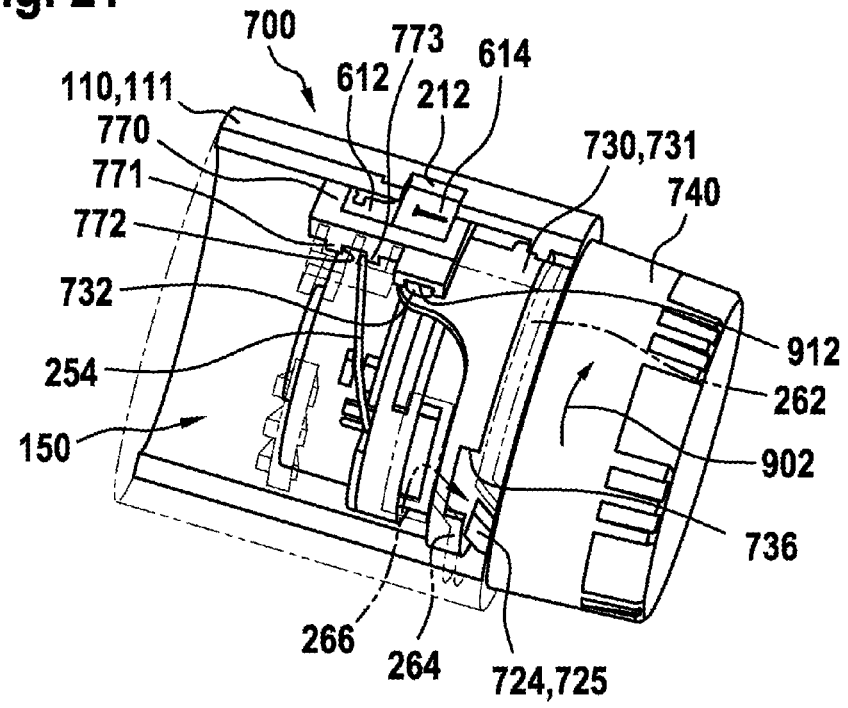

FIG. 21 shows the mode-setting means 700 of FIG. 13 in a screwdriving mode. In this case, the transmission 150 is in the first gear step, and the torque-limiting unit 520 is activated and the percussion mechanism 510 is deactivated. During setting of an operating mode, the actuating element 740 is rotated in the direction of an arrow 902, or in the circumferential direction.

Figure 22:
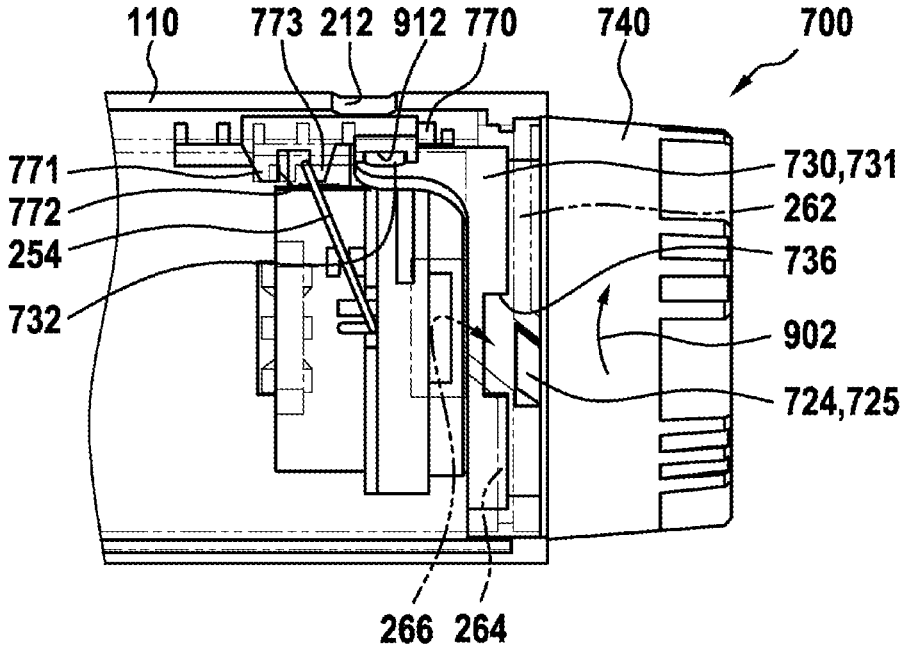

FIG. 22 shows the mode-setting means 700 of FIG. 13, which, in comparison with FIG. 21, has been rotated in the direction of the arrow 902, or in the circumferential direction. In this case, the guide element 725 of the coupling ring 720 is forced by the guide web 262 into the guideway 266 of the housing 110, or of the housing shell 111, that is solid with the housing. In the case of setting of an operating mode contrary to the arrow 902, load is preferably applied to the guide element 725 by the decoupling web 264, the coupling projection 724 being forced out of the coupling recess 736.

Figure 23:
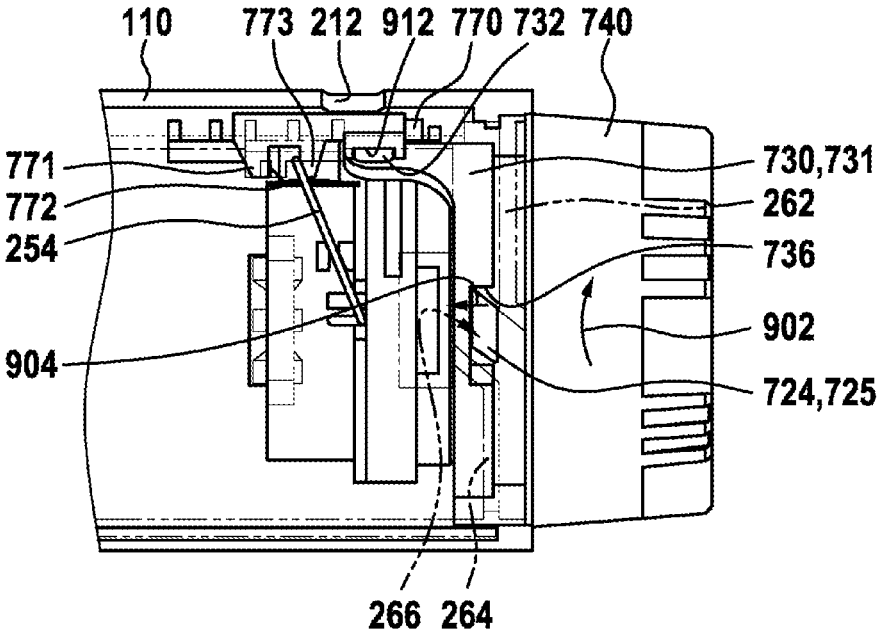

FIG. 23 shows the mode-setting means 700 of FIG. 13, which, in comparison with FIG. 22, has been rotated in the direction of the arrow 902, or in the circumferential direction. In this case, the guide element 725 of the coupling ring 720 is guided along the guideway 266 of the housing 110, or of the housing shell 111, that is solid with the housing, the coupling projection 724 being moved in the direction of an arrow 904, or in the axial direction, into the coupling recess 736 of the gear-changing element 730.

Figure 24:
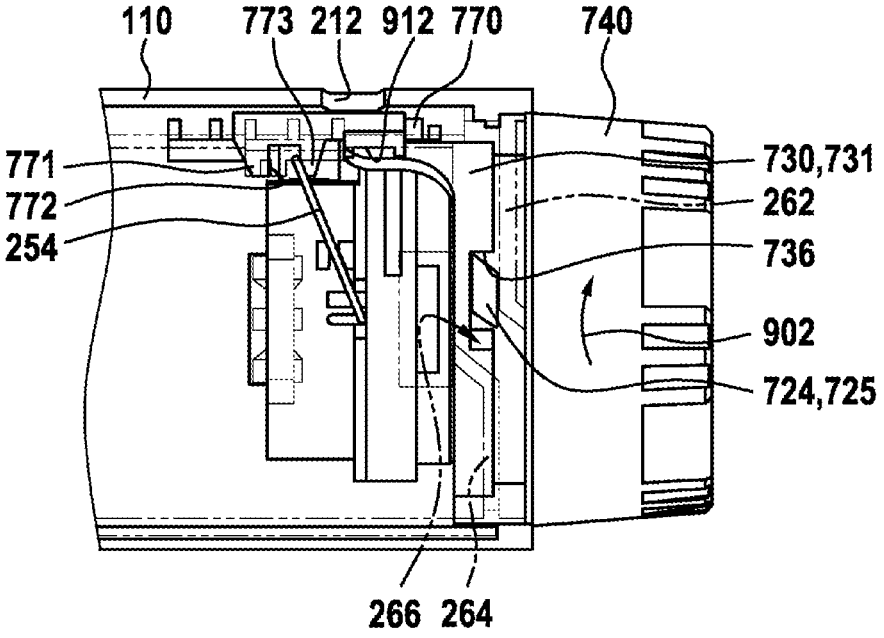

FIG. 24 shows the mode-setting means 700 of FIG. 13, which, in comparison with FIG. 23, has been rotated further in the direction of the arrow 902, or in the circumferential direction. Illustratively, the coupling projection 724 of the coupling ring 720 is arranged in the coupling recess 736 of the gear-changing element 730. In this case, load is preferably applied to the guide element 725 by the guide web 262, to enable the coupling projection 724 to be securely arranged in the coupling recess 736. The arrangement shown in FIG. 24 preferably illustrates a final position of the screwdriving mode, with an activated torque-limiting means 520.

Figure 25:
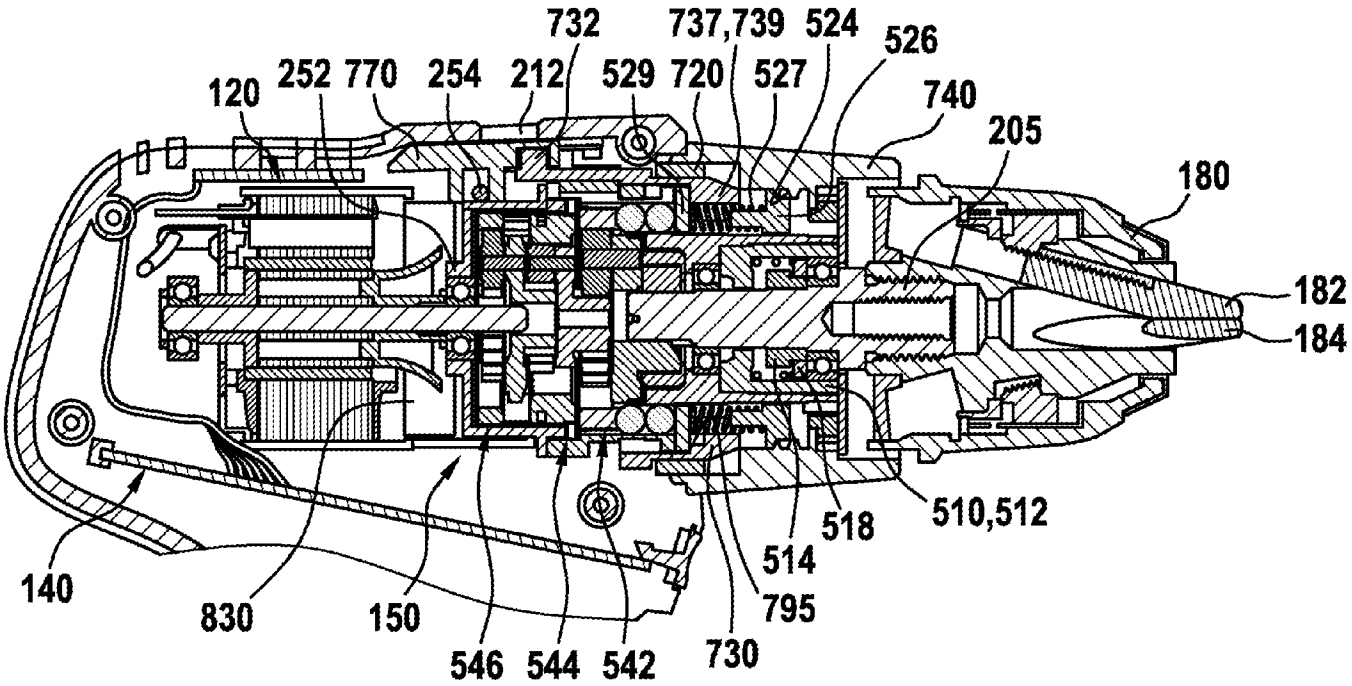

FIG. 25 shows the hand-held power tool 100 of FIG. 18 in the screwdriving mode, with a deactivated torque-limiting unit 520. When a torque-limiting unit 520 is deactivated, the pressure plate 529 is fixed axially, the at least one blocking element 795 preferably applying load to the pressure plate 529 and blocking an axial movement of the pressure plate 529. As with the screwdriving mode with an activated torque-limiting unit 520, in this case the percussion mechanism 510 is deactivated.

Figure 26:
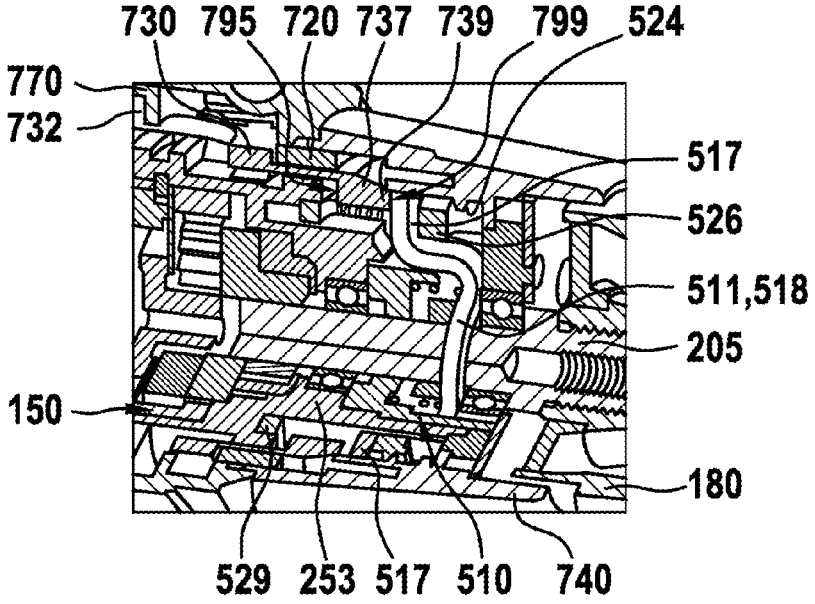

FIG. 26 shows the hand-held power tool 100 of FIG. 26 in the screwdriving mode, with a deactivated torque-limiting unit 520, and, as with the screwdriving mode with an activated torque-limiting unit 520, the percussion mechanism 510 is deactivated. Here, as described in FIG. 20, the limb 517 of the locking element 518 is positioned on the side 799 of the gear-changing element 730 that faces away from the transmission 150, since load is applied to it by the deactivating element 739 of the gear-changing element 730.

Figure 27:
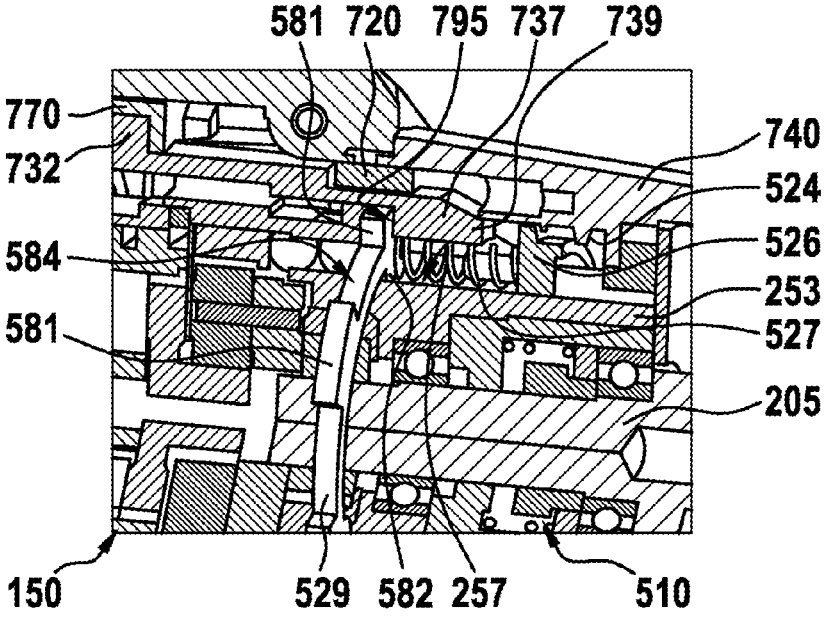

FIG. 27 shows the hand-held power tool 100 of FIG. 25 with a deactivated torque-limiting unit 520. FIG. 27 in this case illustrates the projection 581, which is assigned to the pressure plate 529 and which is blocked by the blocking element 795, such that an axial movement of the pressure plate 529 is blocked.

Figure 28:
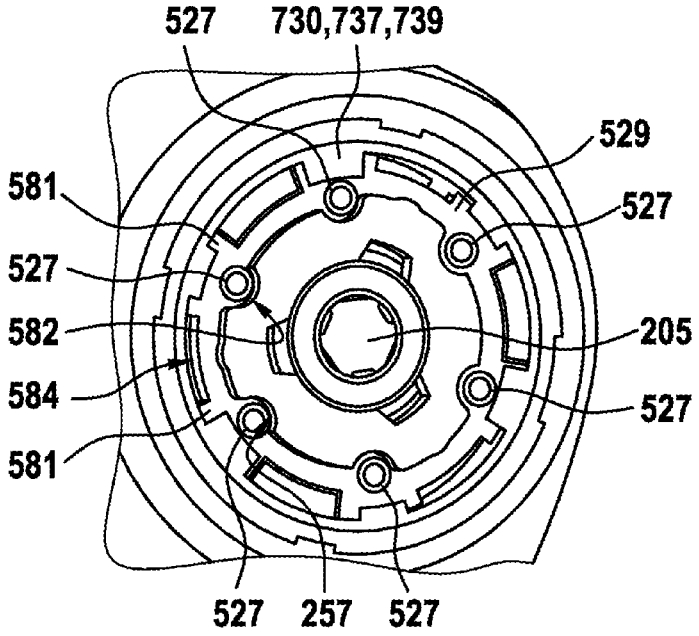

FIG. 28 shows the hand-held power tool 100 of FIG. 27, and illustrates the pressure plate 529 blocked by the region 737, in particular by the blocking element 795, not shown in FIG. 28. In this case, the projections 581 assigned to the pressure plate 529 are positioned at the region 737, as a result of which the axial movement of the pressure plate 529 is blocked. In addition, FIG. 28 illustrates the arrangement of the pressure plate 529, by means of the portions 582, in the recesses 257 of the second transmission housing part 253. Furthermore, FIG. 28 shows the application of load to the pressure plate 529 by the spring elements 527 assigned to the spring holder 526. Preferably, the spring elements 527 apply load in the region of the portions 582.

Figure 29:
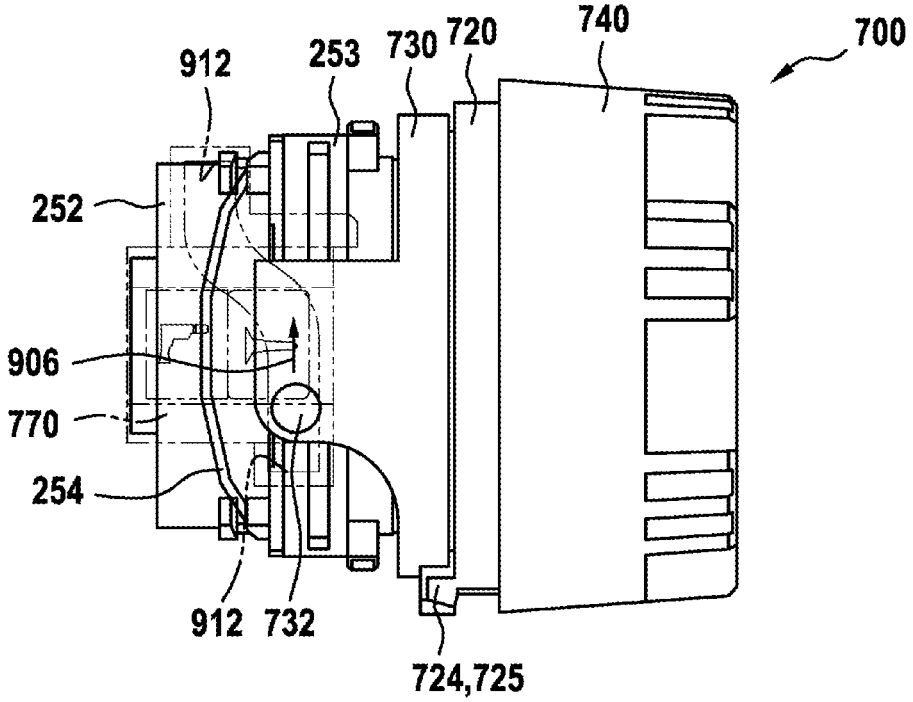

FIG. 29 shows the mode-setting means 700 of FIG. 17 in the screwdriving mode, or in the first gear step of the transmission 150. In this case, the guide pin 732 of the gear-changing element 730 is arranged in the guide groove 912 of the mode indicator element 770. During a gear change, the guide pin 732 moves along the guide groove 912, or in the direction of an arrow 906.

Figure 30:
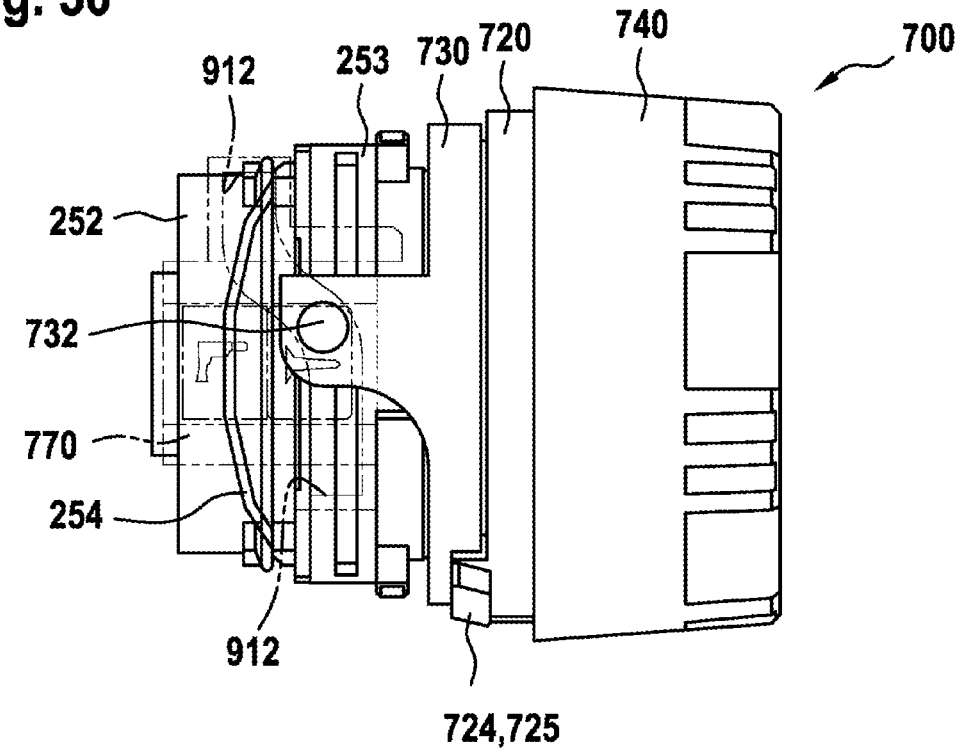

FIG. 30 shows the mode-setting means 700 of FIG. 17, in which, in comparison with FIG. 29, the guide pin 732 has been moved in the direction of the arrow 906 of FIG. 29, or illustratively upward, by rotation of the actuating element 740. FIG. 30 shows the final position before the gear change to the second gear step.

Figure 31:
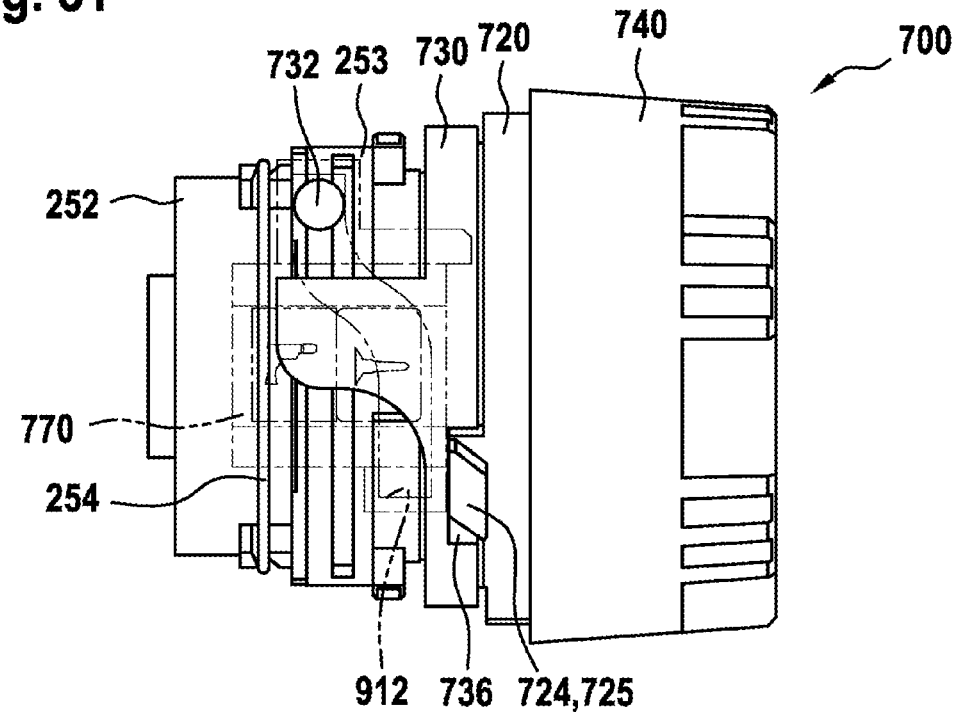

FIG. 31 shows the mode-setting means 700 of FIG. 17 in the second gear step of the transmission 150, or in a drilling mode. In this case, the guide pin 732 is arranged at an illustratively upper end of the guide groove 912, as a result of which the selector bail 254 has forced the transmission 150 from the first and the second gear step.

Figure 32:
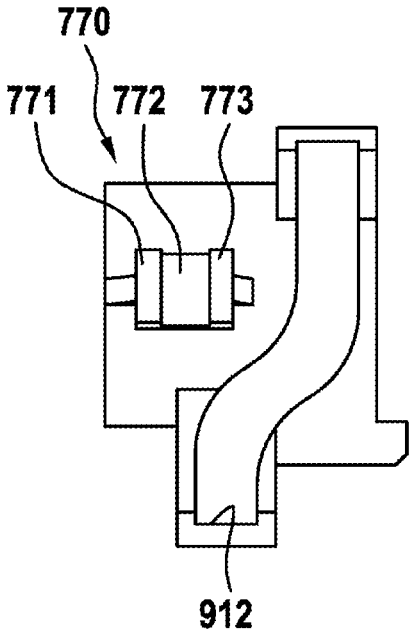

FIG. 32 illustrates the mode indicator element 770 and the guide groove 912 of FIG. 12. The guide groove 912 preferably has an approximately stepped shape. Furthermore, FIG. 32 illustrates the two loading webs 771, 773, as well as the recess 772 for arrangement of the selector bail 254.

Figure 33:
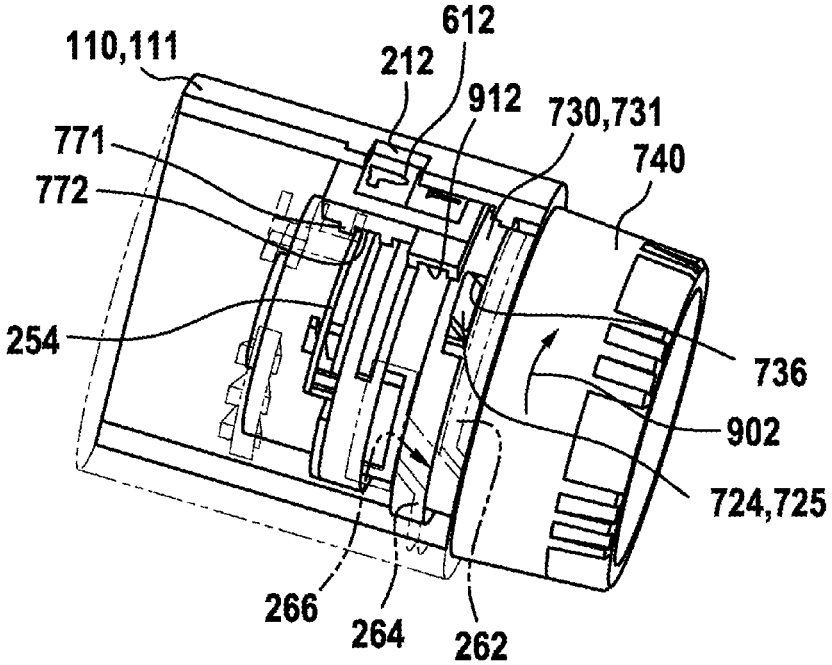

FIG. 33 shows the mode-setting means 700 of FIG. 17 in the drilling mode, or in the second gear step of the transmission 150. For this purpose, the actuating element 740 is rotated in the direction of the arrow 902, or in the circumferential direction, the guide element 725 being moved along the guide web 262, and the guide pin 732 being guided along the guide groove 912. In this case, the mode indicator element 770 is displaced axially, the loading web 771 applying load to the selector bail 254 illustratively to the right, and thus effecting a gear change. The selector bail 254 in this case forces the selector ring gear 547 into the position assigned to the second gear step. The drilling mode in this case is visualized, through the recess 212, by the exemplary drill symbol 612.

Figure 34:
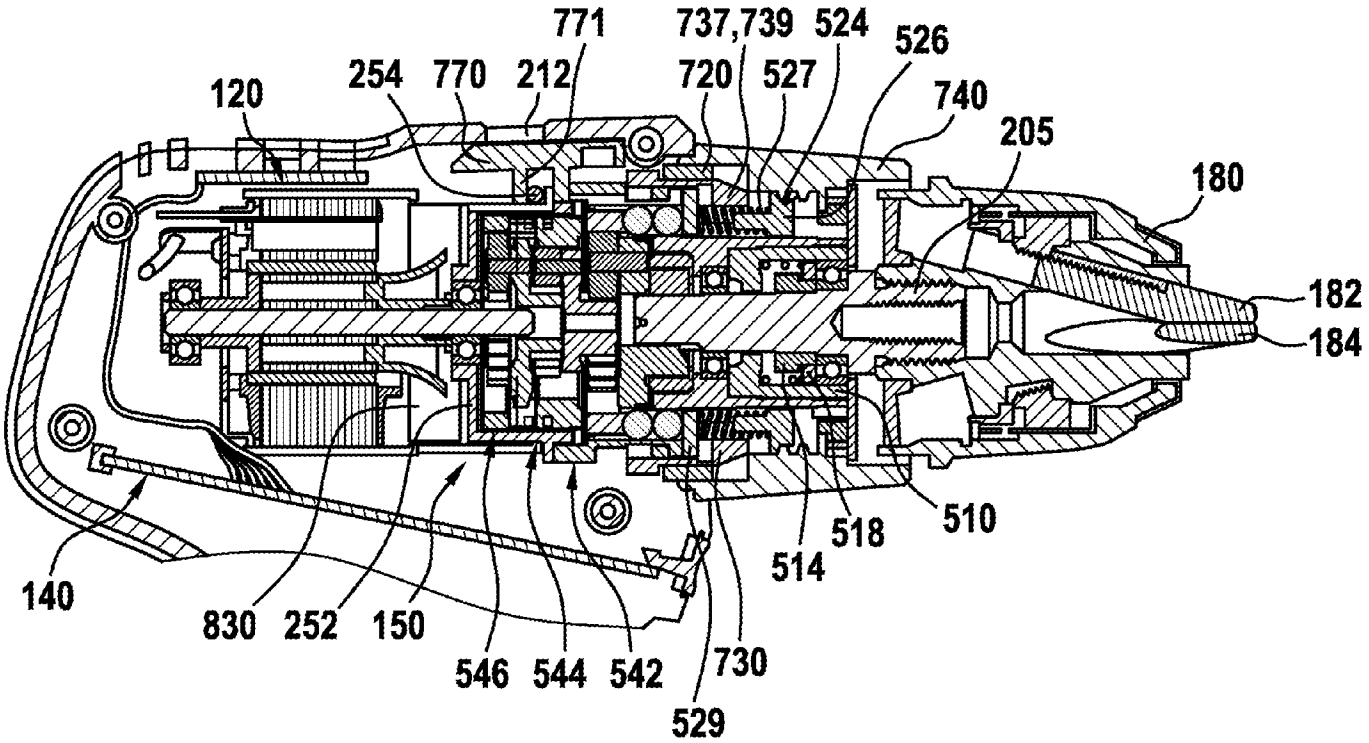

FIG. 34 shows the hand-held power tool 100 of FIG. 25 in the drilling mode, in the second gear step of the transmission 150. In this case, FIG. 34 illustrates the selector ring gear 547 that is to be changed over from the first to the second gear step, the selector ring gear 547 being arranged in the illustratively left position in the second gear step. Furthermore, FIG. 34 in this case shows the mode indicator element 770 illustratively shifted to the right, the selector bail 254 being positioned at the loading web 771. Preferably, in the drilling mode shown in FIG. 34, the torque-limiting unit 520 and the percussion mechanism 510 are deactivated.

Figure 35:
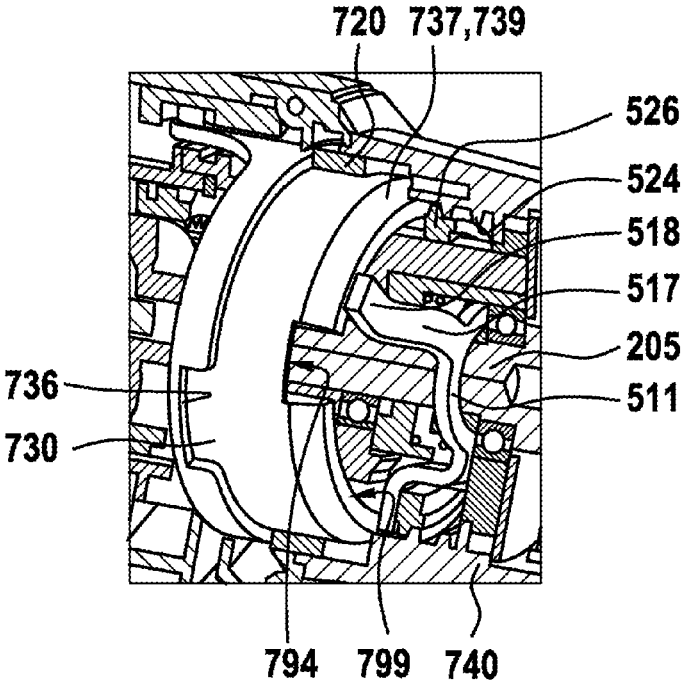

FIG. 35 shows the hand-held power tool 100 of FIG. 34 in the drilling mode. In this case, as described in the case of FIG. 26, the limb 517 of the locking element 518 is positioned on the side 799 of the gear-changing element 730 that faces away from the transmission 150, since load is applied to the limb 517 by the deactivating element 739 of the gear-changing element 730. In comparison with the screwdriving mode of FIG. 26, however, in FIG. 35 the gear-changing element 730 has been rotated in the circumferential direction.

Figure 36:
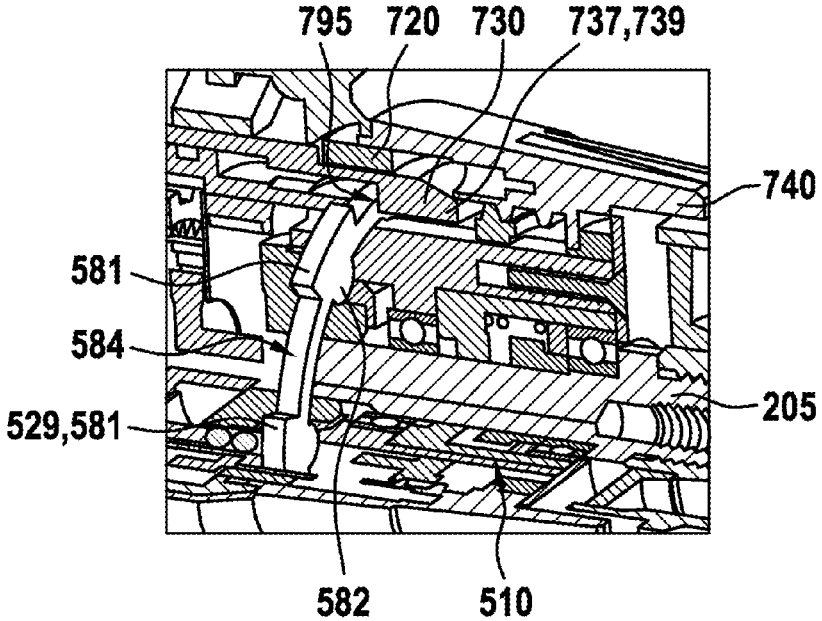

FIG. 36 shows the hand-held power tool 100 of FIG. 34 and FIG. 35 in the drilling mode and with a deactivated torque-limiting means 520. In this case, as in FIG. 27, FIG. 36 illustrates the projection 581 that is assigned to the pressure plate 529 and that is blocked, at least portionally, by the blocking element 795, and thus blocks an axial movement of the pressure plate 529.

Figure 37:
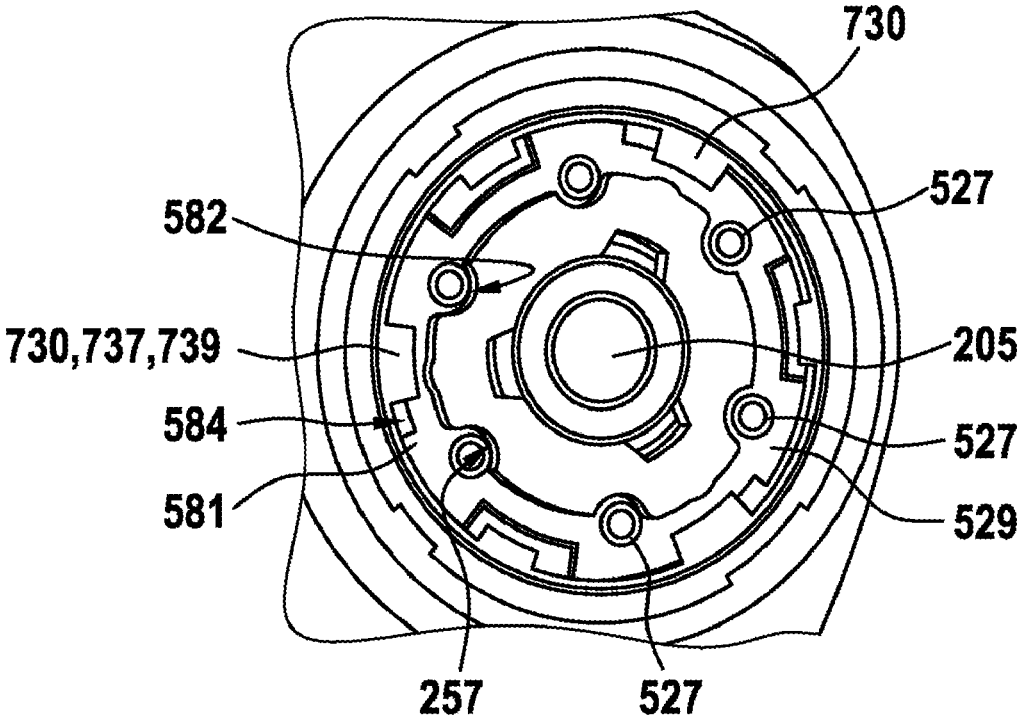

FIG. 37 shows the hand-held power tool 100 of FIG. 18 in the drilling mode, and illustrates the pressure plate 529 blocked by the region 737. In this case, the projections 581 assigned to the pressure plate 528 are positioned portionally on the region 737, as a result of which the axial movement of the pressure plate 529 is blocked.

Figure 38:
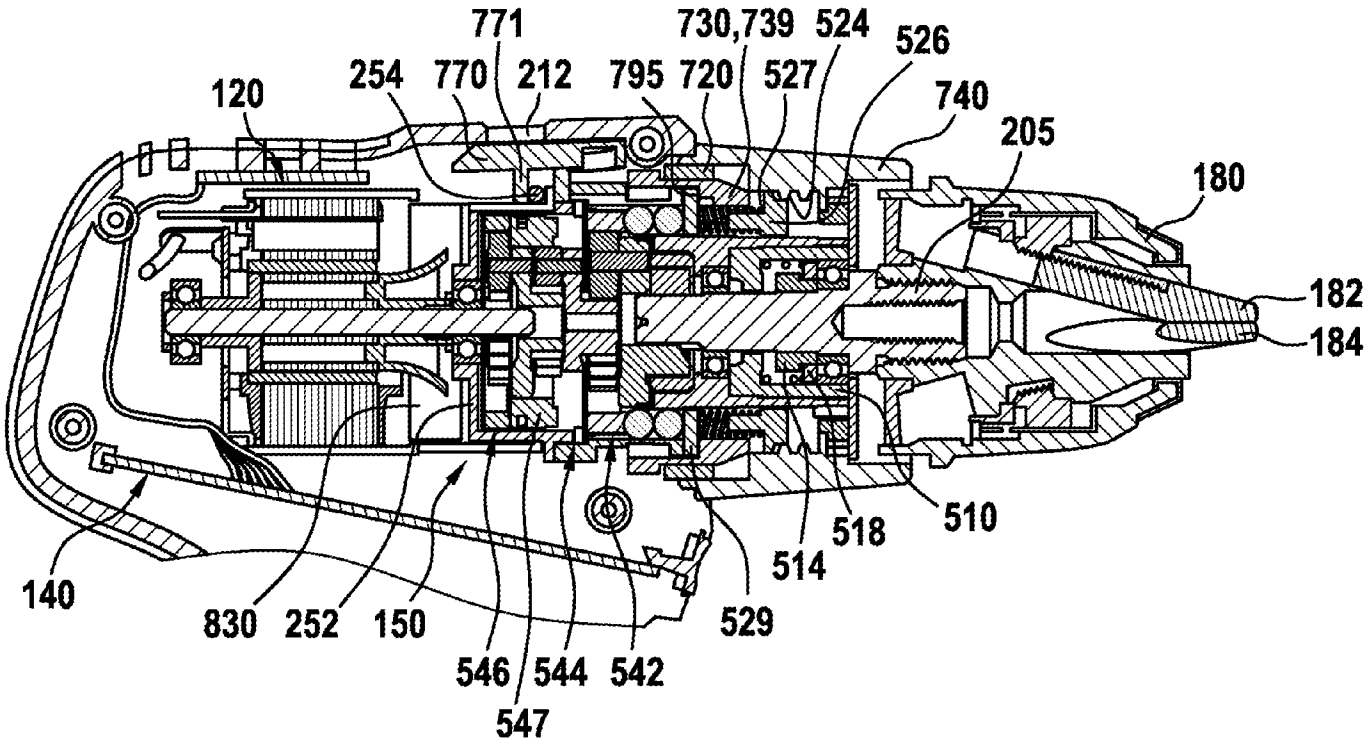

FIG. 38 shows the hand-held power tool 100 of FIG. 18 in the percussive drilling mode, with the gear-changing element 730 having been rotated further in the circumferential direction in comparison with the drilling mode of FIG. 37. In this case, FIG. 38 illustrates the selector ring gear 547 arranged in the second gear step.

Figure 39:
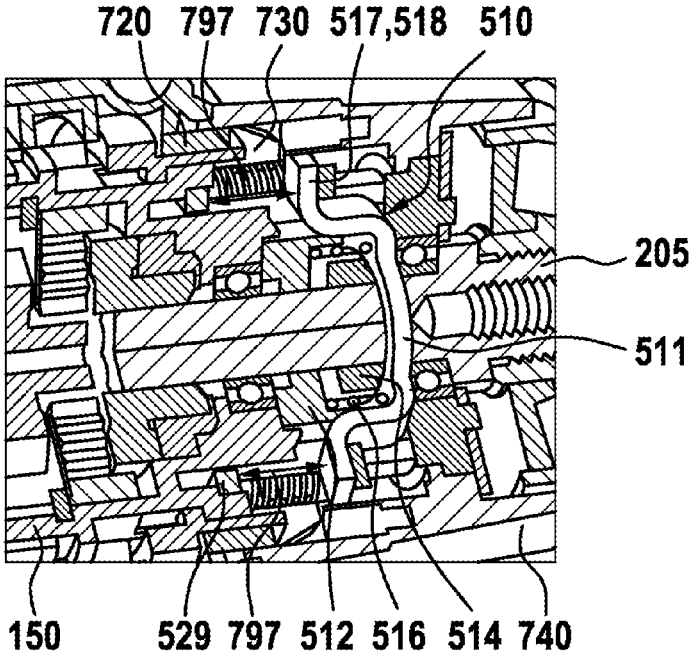

FIG. 39 shows the hand-held power tool 100 of FIG. 38 in the percussive drilling mode, in which the percussion mechanism 510 is activated. In this case, the limbs 517 of the locking element 518 are released by the deactivating element 739 of the percussion mechanism 510. The limbs 517 in this case are preferably arranged on the side of the gear-changing element 730 that faces away from the transmission 150, in particular in the receivers 794 of the gear-changing element 730. The locking element 518 in this case can be moved in the direction of a double arrow 797, or in the axial direction. Upon an axial movement of the locking element 518, the spring element 516 arranged within the latching cup 512 is preferably compressed and decompressed sequentially. The spring element 516 in this case preferably forces the output shaft 205, via the locking element 518 and the ball bearing 519, into an assigned non-latched position, in which the latching cup 512 and the latching disk 514 are not in engagement.

Figure 40:
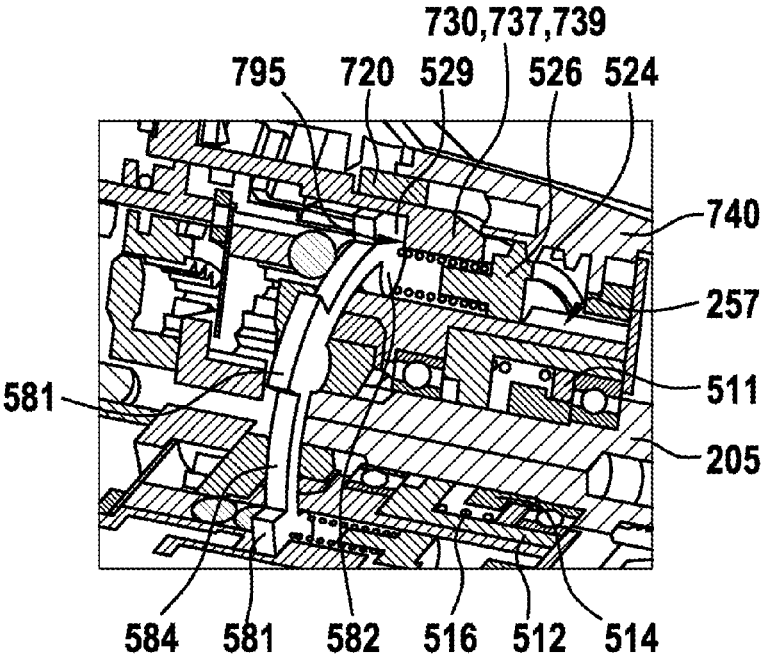

FIG. 40 shows the hand-held power tool 100 of FIG. 38 and FIG. 39 in the percussive drilling mode, with a deactivated torque-limiting means 520. As with FIG. 27 and FIG. 36, FIG. 40 in this case illustrates the projection 581 that is assigned to the pressure plate 529 and that is blocked, at least portionally, by the blocking element 795, and thus blocks an axial movement of the pressure plate 529.

Figure 41:
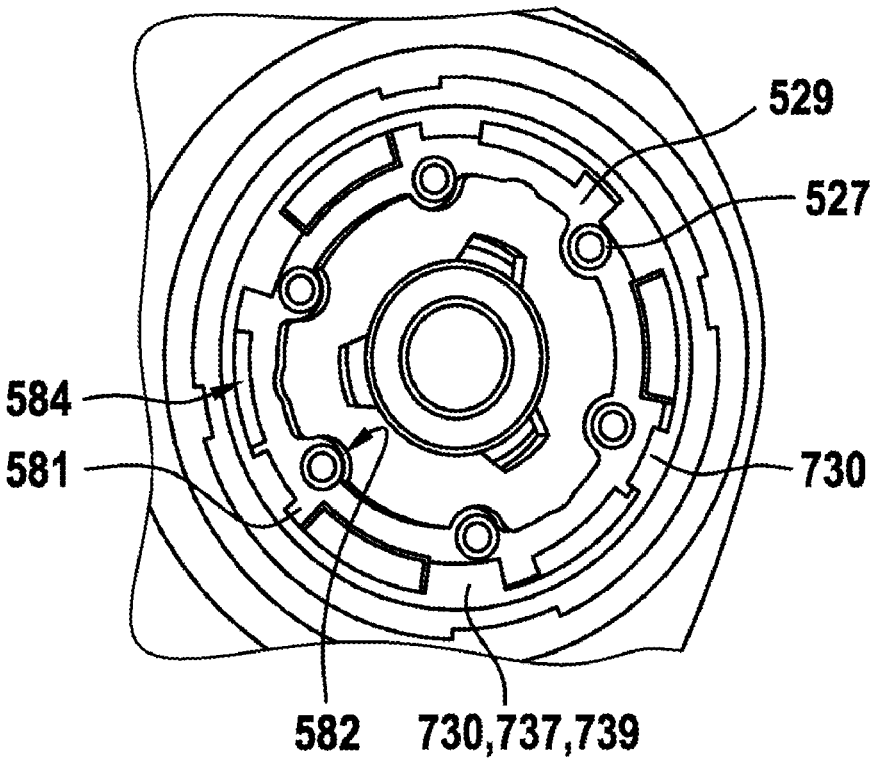

FIG. 41 shows the hand-held power tool 100 of FIG. 40 in the percussive drilling mode, and illustrates the pressure plate 529 blocked by the region 737. In this case, the projections 581 assigned to the pressure plate 528 are preferably portionally positioned at the region 737, as a result of which the axial movement of the pressure plate 529 is blocked.

It is pointed out that the embodiments described may also be combined with one another. Thus, for example, the gear-changing element 230 of the first embodiment may be realized without a gate 234, and preferably have the direct mode-setting means 700 of the second embodiment. Furthermore, the gear-changing element 730 of the second embodiment may have a gate 234, and preferably have the indirect mode-setting means 160 of the first embodiment. In addition, the coupling elements 220, or 720, may also be used in the respectively other embodiment. Thus, the coupling element 220 may be used in the case of the second embodiment, or with the gear-changing element 730, with the preferably direct mode-setting means 700, and/or the coupling element 720 may be used with the gear-changing element 230 of the first embodiment. Furthermore, the torque-setting element 220 may also be realized, in the case of the first embodiment, as a single piece with the actuating element 240, and/or the torque-setting element 720 may be realized as two pieces, e.g. connected to the actuating element 740 by means of a press connection. In addition, the guideway 266 may also be, for example, pressed into the housing 110 via a housing shell.

The invention claimed is:

1. A hand-held power tool, comprising:

a housing;

a drive motor arranged in the housing;

a transmission arranged in the housing and configured to be driven by the drive motor so as to drive an output shaft; and a mode-setting device comprising:

at least one rotatable actuating element configured to set an operating mode, at least one torque-setting element configured to set a torque, and at least one gear-changing element configured to change gears of the transmission, wherein the torque-setting element and the gear-changing element are configured to be separably coupled to each other such that, in at least one position of the actuating element, the torque-setting element and the gear-changing element are decoupled from one another, and wherein, during a gear change, the torque-setting element and the gear-changing element are coupled to one another such that, to change the gears, rotation of the actuating element acts on the gear-changing element via the torque-setting element.

2. The hand-held power tool as claimed in claim 1, wherein during setting of the torque, the torque-setting element and the gear-changing element are decoupled from each other.

3. The hand-held power tool as claimed in claim 1, wherein the mode-setting device further comprises a coupling element that is movably arranged on the torque-setting element and is configured to selectively couple and decouple the torque-setting element and the gear-changing element, and the coupling element couples the torque-setting element to the gear-changing element in such a way that the rotation of the actuating element acts on the gear-changing element via the torque-setting element and the actuating element.

4. The hand-held power tool as claimed in claim 3, wherein the coupling element is arranged in a pivotable manner on the torque-setting element.

5. The hand-held power tool as claimed in claim 3, wherein the coupling element is arranged in an axially movable manner on the torque-setting element.

6. The hand-held power tool as claimed in claim 3, wherein the coupling element has a guide element that, upon a rotation of the actuating element, acts in combination with a guideway, which is solid with the housing, to couple and decouple the torque-setting element and the gear-changing element.

7. The hand-held power tool as claimed in claim 3, wherein the coupling element includes an elastic coupling arm that interacts with the torque-setting element and the gear-changing element to selectively couple the torque-setting element and the gear-changing element.

8. The hand-held power tool as claimed in claim 6, wherein the guideway extends in a circumferential direction on an inner face of the housing.

9. The hand-held power tool as claimed in claim 1, wherein the gear-changing element is rotatably mounted relative to the housing and is configured to rotate with the actuating element during the changing of the gears.

10. The hand-held power tool as claimed in claim 1, further comprising a torque-limiting device, which acts in combination with the torque-limiting device to set a maximum transmissible torque of the power tool.

11. The hand-held power tool as claimed in claim 1, further comprising a percussion mechanism, wherein the mode-setting device is configured to activate and deactivate the percussion mechanism.

12. The hand-held power tool as claimed in claim 1, wherein the transmission is configured as a planetary transmission having a selector ring gear that is acted on by a selector bail so as to shift the planetary transmission, and wherein the gear-changing element has a loading element configured to apply load to the selector bail at least during a gear change.

13. The hand-held power tool as claimed in claim 1, wherein the actuating element is arranged on an exterior of the power tool and is rotatable to set the operating mode.

14. The hand-held power tool as claimed in claim 1, wherein the at least one actuating element is a single actuating element configured to set the torque and actuate the gear change.

15. A hand-held power tool, comprising:

a housing;

a drive motor arranged in the housing;

a transmission arranged in the housing and configured to be driven by the drive motor so as to drive an output shaft and a mode-setting device comprising:

at least one rotatable actuating element configured to set an operating mode, at least one torque-setting element configured to set a torque, and at least one gear-changing element configured to change gears of the transmission, wherein the torque-setting element and the gear-changing element are configured to be separably coupled to each other, wherein, during a gear change, the torque-setting element and the gear-changing element are coupled to one another, wherein the mode-setting device further comprises a coupling element that is movably arranged on the torque-setting element and is configured to selectively couple and decouple the torque-setting element and the gear-changing element wherein the coupling element has a guide element that, upon a rotation of the actuating element, acts in combination with a guideway, which is solid with the housing, to couple and decouple the torque-setting element and the gear-changing element, and wherein the guide element extends in a radial direction of the mode-setting device.

16. A hand-held power tool comprising:

a housing;

a drive motor arranged in the housing;

a transmission arranged in the housing and configured to be driven by the drive motor so as to drive an output shaft; and a mode-setting device comprising:

at least one rotatable actuating element configured to set an operating mode, at least one torque-setting element configured to set a torque, and at least one gear-changing element configured to change gears of the transmission, wherein the torque-setting element and the gear-changing element are configured to be separably coupled to each other such that, in at least one position of the actuating element, the torque-setting element and the gear-changing element are decoupled from one another, wherein, during a gear change, the torque-setting element and the gear-changing element are coupled to one another such that, to change the gears, rotation of the actuating element acts on the gear-changing element via the torque-setting element, and wherein a mode indicator element is assigned to the gear-changing element, the mode- indicator being moved in a longitudinal direction of the housing during setting of the operating mode so as to visualize a respectively assigned operating mode.

17. The hand-held power tool as claimed in claim 16, wherein the mode indicator element is configured as a loading element configured to apply load to a selector bail and/or for displaying the respectively assigned operating mode.

18. The hand-held power tool as claimed in claim 16, wherein the gear-changing element has a guide pin, and the mode indicator element has a guide groove, and wherein the guide pin moves the mode indicator element along the guide groove during setting of the operating mode.

* * * * *